US012460517B2

(12) United States Patent
Keyes et al.

(10) Patent No.: US 12,460,517 B2
(45) Date of Patent: Nov. 4, 2025

(54) INTERLOCKING PERFORATION GUN AND METHODS OF USE

(71) Applicant: Defiant Engineering, LLC, Odessa, TX (US)

(72) Inventors: Cullen Craig Keyes, Hysham, MT (US); Ian Graham Janke, Parkland County (CA); Lawrence Gene Griffin, Morrison, CO (US); Benjamin David Jennings, Houston, TX (US)

(73) Assignee: Defiant Engineering, LLC, Odessa, TX (US)

( * ) Notice: Subject to any disclaimer, the term of this patent is extended or adjusted under 35 U.S.C. 154(b) by 21 days.

(21) Appl. No.: 18/643,288

(22) Filed: Apr. 23, 2024

(65) Prior Publication Data

US 2024/0360742 A1 Oct. 31, 2024

Related U.S. Application Data

(60) Provisional application No. 63/498,377, filed on Apr. 26, 2023.

(51) Int. Cl.
*E21B 43/117* (2006.01)
*E21B 43/119* (2006.01)

(52) U.S. Cl.
CPC ..... *E21B 43/117* (2013.01); *E21B 43/119* (2013.01)

(58) Field of Classification Search
CPC ..... E21B 43/117; E21B 43/119; E21B 43/116
See application file for complete search history.

(56) References Cited

U.S. PATENT DOCUMENTS 2,257,271 A * 9/1941 McCullough ..... E21B 43/116 175/4.58
2,266,343 A * 12/1941 Lloyd ..... E21B 43/116 175/4.58
2,664,158 A * 12/1953 McKean ..... E21B 43/118 175/4.53
2,764,938 A * 10/1956 Harcus ..... E21B 43/117 175/4.6
10,822,931 B2 * 11/2020 Coffey ..... E21B 43/11852
2004/0134658 A1 * 7/2004 Bell ..... E21B 43/116 175/4.6
2020/0109614 A1 * 4/2020 Jones ..... E21B 7/046

* cited by examiner

*Primary Examiner* — D. Andrews
(74) *Attorney, Agent, or Firm* — Workman Nydegger

(57) ABSTRACT

A reloadable, reusable, downhole interlocking gun and perforation system having two interlocking bodies that each include multiple receivers and barrels. The interlocking bodies are configured to interlock together with each other so that a receiver of one of the interlocking bodies is aligned with a corresponding barrel of the other of the interlocking bodies. Each of the receivers is configured to receive a respective projectile for firing out of the barrel that is aligned with the receiver.

16 Claims, 16 Drawing Sheets

INTERLOCKING PERFORATION GUN AND METHODS OF USE

TECHNOLOGICAL FIELD OF THE DISCLOSURE

Example embodiments disclosed herein are directed to perforation guns. More specifically, one embodiment is directed to a perforation gun comprising two interlocking halves.

BACKGROUND

Perforation guns used in oil and gas wells are designed as disposable tools that cannot be reused after use. The primary reason for this is the damage and deformation to the gun components during the perforation process.

During the perforation process, the perforation gun is lowered into the wellbore and then activated to fire shaped charges that create perforations in the casing, cement, and formation of the well. The explosion generated by the shaped charges creates significant shock and vibration, which results in permanent deformation of the gun components. In addition, the explosion creates high temperatures and pressures that result in the warping and distortion of the gun body or tube.

Even if the gun components do not appear to be damaged, the tube that houses the shaped charges, carrier, and electronics is permanently damaged and there is microscopic damage that has occurred that compromises the structural integrity of the gun. This can make the gun unfit for future use after it has already been through one usage.

To minimize the risk of equipment failure and ensure the safety of well operators, perforation guns are designed to be used only once and then discarded. The disposable nature of these tools allows for the use of new, undamaged equipment for each perforation operation, thereby reducing the risk of equipment failure and increasing the overall safety and reliability of the well.

Perforation guns are used in oil and gas well completion operations to create holes in the casing, cement, and formation to allow hydrocarbons to flow into the wellbore. The disposable perforation gun tubes are a critical component of the perforation gun assembly that carries the shaped charges that create the perforations.

The material used to make disposable perforation gun tubes must have certain properties, including high strength, corrosion resistance, and the ability to withstand the high-pressure environment of the well. None of the tubes are designed with barrels, but scallops and bands are machined into the outer surface that the shaped charges are designed to fire through. The following are some of the alloy materials that are commonly used to make disposable perforation gun tubes:

1. 13Cr stainless steel: 13Cr stainless steel is a martensitic stainless steel that has high strength, hardness, and wear resistance. It also has good corrosion resistance in low pH environments. This material is commonly used in oil and gas well completions.

2. 9Cr-1Mo steel: 9Cr-1Mo steel is a low-alloy steel that is commonly used in high-temperature, high-pressure applications, such as steam boilers and pressure vessels. It has excellent strength and corrosion resistance.

3. 4140 Alloy Steel: This low alloy steel is commonly used in the oil and gas industry due to its high strength, toughness, and resistance to corrosion. It is particularly well-suited for perforation gun tubes due to its ability to be heat treated to increase its strength and durability.

4. 4130 Alloy Steel: Another low alloy steel commonly used in perforation gun tubes is 4130 steel. It has a similar composition to 4140 steel but with a lower carbon content, making it more weldable and easier to form. Like 4140, it can be heat treated to improve its strength and toughness.

5. 17-4 PH Stainless Steel: This precipitation hardening stainless steel is often used in the manufacturing of perforation gun tubes due to its high strength, corrosion resistance, and ability to be heat treated to further increase its strength. It is particularly well-suited for use in corrosive environments.

6. Hastelloy C-276: Hastelloy C-276 is a nickel-molybdenum-chromium alloy that has excellent corrosion resistance in a wide range of environments, including strong acids and chlorine solutions. It also has high strength and is commonly used in chemical processing and oil and gas applications.

Scallops and Bands

Scallops and bands are machined into the outer diameter of oil and gas perforation gun tubes for several reasons:

1. Minimize gun sticking downhole: When a shaped charge fires through the gun tube, a bur may be created on the outer diameter of the gun tube. In some cases, it is possible that the bur may make the gun tubes outer diameter greater than the internal diameter of the casing. In turn, will stick the gun downhole and potentially cause the gun to part, or force the operator at the surface to release the gun string down hole and leave it in place to fish out of the wellbore at a later date.

2. To minimize charge-to-charge interaction: Charge-to-charge interaction can occur when two or more shaped charges are fired in close proximity, causing damage to the well casing and reducing the effectiveness of the perforation. The scallops and bands help to reduce charge-to-charge interaction by providing a barrier between adjacent charges.

3. To improve the efficiency of the perforation: The scallops and bands help to create a more consistent and uniform perforation of the well casing. The bands, in particular, can help to enhance the penetration of the shaped charges into the casing, resulting in a cleaner and more effective perforation.

4. To reduce material usage: Machining scallops and bands into the outer diameter of the perforation gun tubes can help to reduce the amount of material used to manufacture the tubes. This can help to reduce the overall cost of the perforation gun system, making it more affordable for oil and gas companies.

Overall, the scallops and bands machined into the outer diameter of oil and gas perforation gun tubes are critical for ensuring the gun does not stick or get stuck downhole, minimizing charge-to-charge interaction, improving the efficiency of the perforation, and reducing material usage.

Shaped Charges

A shaped charge is a device that is designed to create a high-velocity jet of metal that can penetrate through a variety of materials, including rock and steel. The basic design of a shaped charge includes a hollow cylinder made of metal, typically copper or a copper alloy, which contains an explosive material at one end. The other end of the cylinder is covered with a metal liner, which is typically made of a dense, high-strength material such as tungsten or steel. The liner is formed into a cone shape and has a small opening, called the apex, at the tip.

When the explosive material is detonated, it produces a high-pressure shock wave that travels down the length of the cylinder and is focused onto the apex of the liner. The shock wave compresses the metal in the liner and creates a high-velocity jet of metal that emerges from the apex of the cone. The jet is able to penetrate through the target material and create a hole or perforation.

The design and manufacturing of shaped charges for oil and gas perforation guns is a highly specialized process. The shaped of the liner, the size and shape of the apex opening, the type and amount of explosive material, and the dimensions and properties of the metal cylinder are all carefully engineered to produce the desired performance characteristics. The goal is to create a shaped charge that can penetrate through the formation rock surrounding the wellbore, while minimizing damage to the well casing and completion equipment.

The process typically involves using computer-aided design (CAD) software to model the shaped charge and simulate its performance. The design is then refined and optimized based on the simulation results, and a prototype is built and tested to verify its performance. The manufacturing process typically involves precision machining of the metal components to tight tolerances, as well as the careful assembly and loading of the explosive material.

Shaped Charge Perforation Gun Propellants

HMX: Octahydro-1,3,5,7-tetranitro-1,3,5,7-tetrazocine, is a high-energy explosive propellant used in perforation guns for oil and gas well operations. HMX has a chemical formula of $C_4H_8N_8O_8$ and a molecular weight of 296.15 g/mol. Its molecular structure consists of an eight-membered ring of nitrogen and carbon atoms with alternating nitro groups attached to the ring.

HMX is a white crystalline powder that is relatively insensitive to shock, impact, and friction, making it a safe and reliable explosive for use in oil and gas well perforation guns. It has a high energy output and a high detonation velocity, which makes it effective in perforating steel casing and rock formations.

The manufacture of HMX involves a multi-step process, starting with the nitration of cyclotrimethylenetrinitramine (RDX) with a mixture of nitric and sulfuric acids. The resulting HMX crystals are then washed, dried, and sieved to the desired particle size for use in perforation gun charges.

In addition to its high energy output and insensitivity to shock, HMX has a relatively high thermal stability, which makes it resistant to accidental detonation due to heat exposure. However, HMX can undergo decomposition under certain conditions, such as prolonged exposure to high temperatures, humidity, or ultraviolet light, which can degrade its performance and safety characteristics. Therefore, proper storage and handling of HMX propellant is essential to ensure its reliability and safety in oil and gas well perforation operations.

RDX: RDX (Research Department Explosive) is a powerful explosive material that is used in the propellants of perforation guns that are used to perforate oil and gas wells. The chemical composition of RDX is $C_3H_6N_6O_6$. It is a white crystalline powder that is relatively insensitive to impact and friction compared to other explosives.

RDX is a member of the nitramine family of explosives, which are made by the reaction between nitric acid and an amine compound. RDX is made by the reaction between concentrated nitric acid and hexamine. The resulting product is washed, dried, and ground into a fine powder.

RDX has a high energy density and is highly stable under normal conditions, making it an ideal explosive for use in perforation guns. When RDX is ignited, it releases a large amount of energy, which is used to drive the shaped charge in the perforation gun.

RDX has a number of desirable properties that make it ideal for use in perforation guns, including:

1. High energy density: RDX has a very high energy density, which means that it can release a lot of energy in a very short amount of time.
2. High stability: RDX is highly stable under normal conditions, which means that it is not likely to detonate accidentally.
3. Low sensitivity: RDX is relatively insensitive to impact and friction compared to other explosives, which makes it safer to handle.
4. High detonation velocity: RDX has a very high detonation velocity, which means that it can quickly and efficiently transfer its energy to the shaped charge.

Example of shaped charge perforation gun design, manufacturing, assembly, test, and field deployment. A shaped charge perforation gun is a piece of equipment used to perforate the casing and cement sheath in oil and gas wells. The design and manufacturing process for these guns involves several stages.

1. Design: The first step in the process is to design the perforation gun. This involves determining the dimensions of the gun and its components, including the outer diameter, length, and the shape and size of the charge cavities.
2. Material selection: The materials used to construct the perforation gun must be carefully chosen to ensure that they can withstand the high pressures and temperatures encountered during perforation. Typically, the gun is made from high-strength alloys such as 4130 or Stainless Steel.
3. Fabrication: The gun is fabricated using a combination of machining and welding techniques. The shaped charge carrier is typically machined from a solid piece of material, while the outer body of the gun is made by welding together several sections.
4. Assembling the shaped charge: The shaped charge is assembled using a combination of explosive and metal liners. The explosive is typically HMX or RDX, which is shaped into a cone and placed in the charge cavity. The metal liner is then placed over the explosive cone, and the whole assembly is sealed with a copper disc.
5. Testing: Once the perforation gun is assembled, it is tested to ensure that it will perform as expected. This involves testing the gun under simulated downhole conditions to determine its performance characteristics, such as penetration depth and hole size.
6. Field deployment: After the perforation gun has been tested and proven to be reliable, it is deployed downhole and used to perforate the casing and cement sheath in the oil or gas well.

BRIEF DESCRIPTION OF THE DRAWINGS

In order to describe the manner in which at least some of the advantages and features of one or more embodiments may be obtained, a more particular description of embodiments will be rendered by reference to specific embodiments thereof which are illustrated in the appended drawings. Understanding that these drawings depict only typical embodiments and are not therefore to be considered to be limiting of the scope of this disclosure, embodiments will be described and explained with additional specificity and detail through the use of the accompanying drawings.

DETAILED DESCRIPTION OF SOME EXAMPLE EMBODIMENTS

A. Introduction

Figure 1:
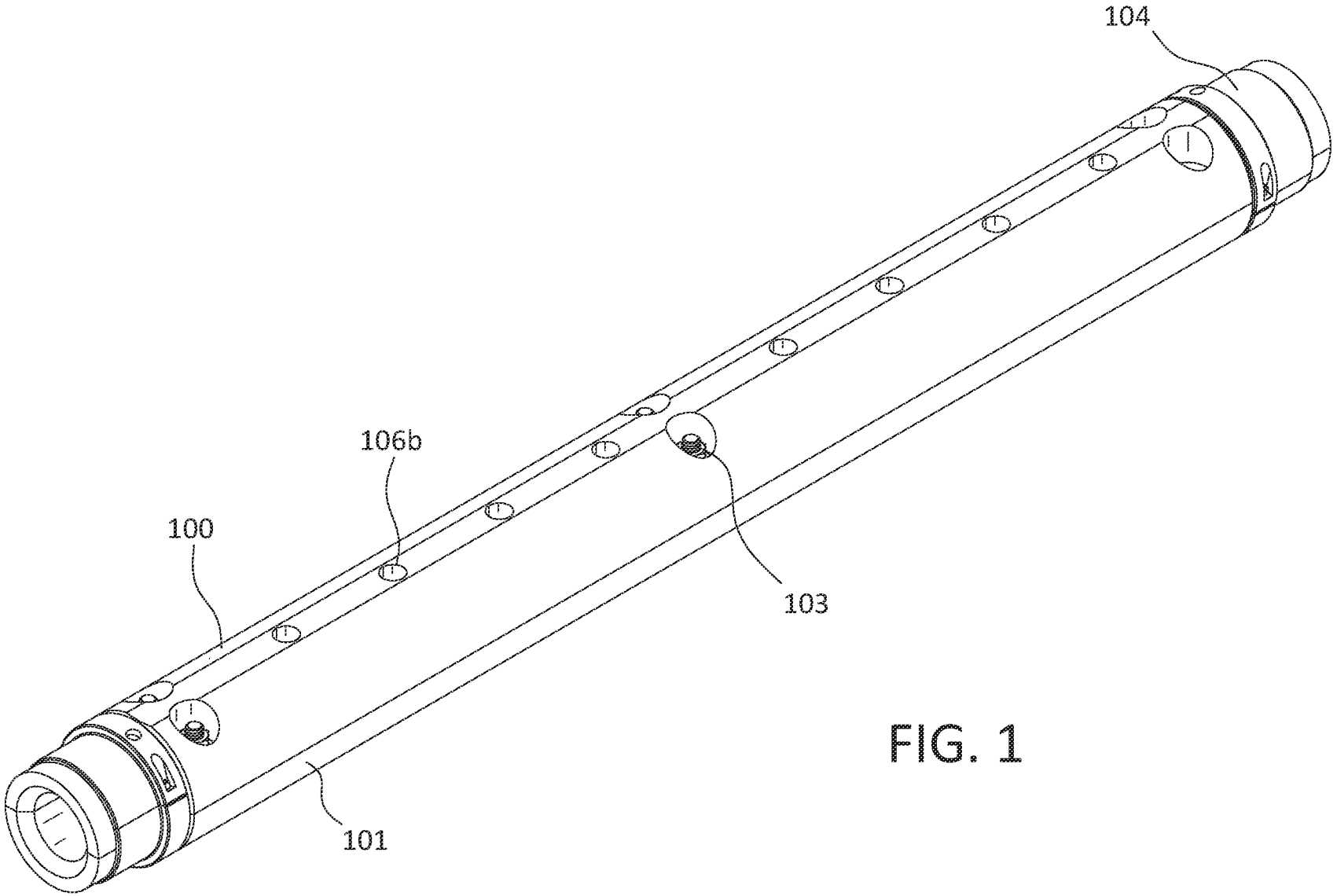
FIG. 1 discloses an example IPG system assembly according to one embodiment.

In an embodiment, an Interlocking Perforation Gun (IPG) System, which may be referred to herein as 'IPG,' or 'IPG System,' is a reloadable, reusable, downhole oil, gas, geothermal or any wellbore application for a perforation system that may be used during the frac'ing, completions, stimulations, and remedial work operations that may be performed downhole in an oil and gas well from the beginning of the wells life cycle, and throughout. The IPG System may be run in tandem with multiple other devices and downhole tools during operation such as, but not limited to, plugs, setting tools, CCL's, eccentric orienting subs, swivels, release tools, as well as data acquisition tools such as sensors subs, imaging devices, and logging tools.

In an embodiment, an IPG comprises a reloadable, reusable, perforation gun system that may comprise two gun bodies, or gun body portions, that releasably interlock together to make a single gun. Both gun bodies may be loaded with propellant and penetrators with each gun body comprising barrels, propellant chambers, interlocking barrel interfaces, and an electronic tray that may comprise electrical communication and power wires, pressure sensors, temperature sensors, and accelerometers. The IPG Systems gun bodies may then radially interlock together to make up the completed gun assembly.

When the IPG System is interlocked together, the barrels are matched together with their corresponding penetrator and propellant chamber. The seamless transition from the barrel to the penetrator and propellant chamber makes for a final barrel assembly that may result in a higher performance gun system due to no, or limited, gaps in the barrel. This design may enable improved performance that may include reduced recoil and minimized effects on barrel harmonics that may cause the barrel to vibrate and ultimately affecting the trajectory of the penetrator. A consistent shot may be achieved by the interlocking barrels design to dampen the vibration and shock effect that may be created by the high pressure generated by the ignition of the propellant.

When the IPG System is loaded with high-velocity heavy-grain penetrators, gas expansion is significant and the interlocking barrel design of the IPG System may significantly reduce the effects of the expansion of gas and maintain a stable consistent pressure inside of the barrel when the propellant is ignited. This may result in increased stability of the penetrator as well as increased muzzle velocity. Which, due to the standoff distance between the end of the barrel and the ID of the casing wall, may be important in the operation of firing a penetrator to penetrate and perforate casing walls along with oil and gas formations. Due to added stability and mechanics of the ability of the interlocking barrel ability to reduce gas expansion, dampen recoil, vibration, and shock may also add to the overall life span of the IPG System. This may ultimately enable the gun to be fired, pulled out of the wellbore, disassembled, reloaded with propellant, penetrators, and a new wire harness, and reassembled and connected to the BHA (bottom hole assembly) and ran back in the wellbore to fire more penetrators and create more perforations.

Any of the disclosed propellants may comprise, for example, tracers (such as may comprise radioactive materials), smart technology such as nano technology, that may be released after the propellant is ignited. These elements may be loaded into a propellant chamber along with the propellant and, when the penetrator is expelled from the barrel, the tracers, devices, and nanotechnology survive the blast and can flow freely out of the propellant chamber and out of the barrel and flow into the wellbore, perforations, and fractures in the formation.

In an embodiment, nano technology may include, but is not limited to, nanobots, nano-technology that may comprise nano tubes configured and operable to deliver high or low frequency precision signals. In an embodiment, the signals may be encoded within the nanotubes, which in turn may enable the nanobots to communicate with other nanobots and/or to transmit any type of information to components such as, but not limited to, a receiver that may be part of the downhole tool assembly. In an embodiment, a projectile, such as a bullet for example, may house smart nanobots that are released from the bullet once the bullet fragments. The nanobots may comprise polymers, ceramics, and exotic alloys for armor. The nanobots may be lodged in the perforation that has been made when the penetrator penetrates the well casing and cement and lodges itself into the formation. After the nanobots have been released, when the formation fractures during the frac, the nanobots may travel throughout the fractures and collectively form a mesh network that may be used to map a formation and communicate information.

An embodiment of the IPG System may take the form of a wet system, meaning that the system does not require sealing of the interlocking gun bodies, and fluids from downhole are allowed to flow throughout the system, constantly and consistently through the barrels and the electronics tray. This may enable the IPG System to naturally pressurize itself to the downhole environment without causing any harm to the components of the system or effecting the overall performance of the system. An IPG System configuration in which the gun barrels are interlocked to the penetrators and propellant chambers may enable a high degree of flexibility and configurability when it comes to configuration, with barrels being machined, or printed, in a variety of lengths, diameters, shapes, calibers, and the phasing and orientation of the gun barrels.

An embodiment of the IPG system may also enable one, or more, barrels, penetrators, and propellant chambers to be designed and incorporated into the system. An interlocking gun according to one embodiment may perform multiple phasing perforations, that is, the IPG system may have the ability to shoot in multiple radial directions in a sequence, or all at the same time. An IPG System may not need to be mechanically and or automatically oriented, or self-oriented with the interlocking gun ability to be interlocked in flexible configurations.

In one embodiment, the IPG System may use, but is not limited to use of, penetrators, or bullets, to perforate oil and gas well casings, and formations. Bullets, penetrators, and other projectiles, may be referred to hereafter individually and collectively as 'penetrators. The penetrators may be initiated by an electrical primer that ignites a propellant. When the propellant is ignited, the penetrators are expelled through the IPG Systems barrels and perforate the casing and penetrate through the cement sheath and subterranean formation, or formations. The penetrator may fragment, or disintegrate, after the penetration of the formation has been accomplished.

Due to the flexibility of the interlocking barrels design, the barrel may have a larger inside diameter than the outside diameter of the penetrator. This may enable the use of penetrators of various diameters, densities, grains, and masses, in the same IPG system. For example: a barrel of an IPG System may have a 0.750" internal diameter barrel, with a length of 1.800" to 2.750," that can accommodate a penetrator outer diameter ranging from, but not limited to, 0.200" to 0.745."

An embodiment of an IPG System and design of interlocking barrels may make for a stronger and more rigid penetrator, or bullet, perforation system that can handle significantly higher pressures than a normal barrel design. The IPG Systems interlocking barrel design allows for a larger contact area between the barrels, which helps to distribute the pressure more evenly and reduce the risk of failure. Additionally, the use of high-strength materials and advanced manufacturing techniques can further increase the strength and durability of an embodiment of the barrel.

B. Materials and Processes

Example Propellants for One Embodiment

1. Vihtavuori Powder: Vihtavuori N100, N300, and N500 are series of powders, such as 3N37, are known to contain nitrocellulose, which is a common component of smokeless powders, as well as other additives to modify its burning rate and other characteristics.

2. Alliant Power Pistol: This powder is designed for high-velocity loads and is known for its consistent performance and clean burn characteristics.

3. Hodgdon Universal: This powder is a versatile option for a wide range of cartridges and is known for its clean burn and low flash signature.

4. Accurate No. 5: This powder is designed for high-performance handgun cartridges and is known for its consistent burn rates and low flash signature.

5. Ramshot True Blue: This powder is designed for high-pressure cartridges and is known for its consistent performance and low muzzle flash.

6. Winchester AutoComp: This powder is designed specifically for competitive shooters and is known for its clean burn and consistent performance.

7. IMR Target: This powder is designed for low-recoil cartridges and is known for its clean burn and low flash signature.

8. Alliant Green Dot: Alliant Green Dot is a versatile and consistent powder that has clean-burning properties and consistent performance.

9. Hodgdon TITEWAD: Hodgdon TITEWAD is a smokeless powder designed to offer consistent performance and low recoil.

10. Hodgdon H4350: This propellant is a member of the Extreme series powders from Hodgdon and is known for its excellent performance. It has a consistent burn rate and produces high velocities.

11. Alliant Reloder 16: This propellant is designed to provide excellent accuracy and consistency, thanks to its clean-burning characteristics.

12. Ramshot Hunter: This propellant is designed for use in a variety of cartridges. It is known for its clean burn and consistent performance, even at high operating temperatures.

13. IMR 4166: This propellant is part of IMR's Enduron series of powders and is designed to provide consistent performance across a range of temperatures and humidity levels. Vihtavuori N560: This propellant is known for its high energy and consistent burn rate, which makes it a popular choice for long-range shooting applications.

14. Accurate 4350: This propellant is known for its clean burn and consistent performance, even at high operating temperatures.

15. Winchester 760: This propellant is a favorite among benchrest shooters and is known for its clean burn and consistent performance, even at high operating temperatures.

16. Ramshot Magnum: This propellant is designed to provide excellent performance across a wide range of temperatures.

17. Hodgdon Varget: This propellant is known for its clean burn and consistent performance. It is designed to provide high velocities with low extreme spreads.

18. Alliant Reloder 23: This propellant is known for its clean burn and consistent performance. It has a high operating temperature range and provides excellent accuracy and consistency.

19. Alliant Unique: This powder is a fast-burning, double-base spherical powder that delivers consistent performance for a variety of pistol calibers. It is also clean burning and has a high energy output.

20. Vihtavuori N320: A fast-burning, single-base, porous powder, Vihtavuori N320 is clean burning and delivers consistent performance. It has a high energy output and is capable of high operating temperatures.

21. IMR Trail Boss: A low-density, bulky powder designed for low-velocity loads. IMR Trail Boss is clean burning and delivers consistent performance.

22. Vectan Ba10: A fast-burning, double-base, spherical powder that works well with a range of pistol calibers, Vectan Ba10 delivers consistent performance and clean burning. It has a high energy output and is capable of high operating temperatures.

23. Hodgdon Titegroup: This is a spherical powder that is known for its clean burn and high velocity.

24. Alliant Bullseye: This is a fast-burning, double-base, spherical powder that is commonly used for low-to-medium velocity loads in handguns and shotguns. It is also known for its consistent performance and clean burn.

25. Accurate No. 2: This is a fast-burning, double-base, spherical powder that is commonly used for low-to-medium velocity load. It is known for its clean burn, low flash, and versatility.

26. Norma R1: This powder is a fast-burning propellant powder that can produce high velocities in a range of pistol and shotgun loads. Its burn rate is typically faster than many other propellant powders.

27. Vihtavuori N310: This powder is a fast-burning, single-base propellant powder that is well-suited for use in light loads with small caliber pistols and revolvers. Its burn rate is relatively fast, which can produce high velocities and low recoil in the appropriate loads.

28. Alliant e3: Alliant e3 powder is a smokeless powder specifically designed for delivering consistent and clean burning performance with low recoil and reduced muzzle flash. Its advanced formula provides optimal loading density, resulting in higher shot velocities for maximum efficiency.

29. Ramshot Competition: Ramshot Competition powder has a consistent burn rate and clean-burning properties, which help to reduce fouling and increase accuracy. It also has a low flash signature and is versatile.

30. Ramshot Zip: Ramshot Zip powder is known for its high velocity and consistent ignition. Its clean-burning properties also contribute to longer barrel life.

31. Accurate Arms Nitro 100: Accurate Arms Nitro 100 powder is a versatile powder that is clean burning and offers consistent velocities and low recoil.

32. RDX: RDX (Research Department Explosive) chemical formula of C3H6N6O6. HMX: Octahydro-1,3,5,7-tetranitro-1,3,5,7-tetrazocine, chemical formula of C4H8N808.

33. Single-based propellant: A single based fuel/propellant has nitrocellulose as its chief explosives ingredient. Stabilizers and other additives are used to control the chemical stability and enhance its properties.

34. Double-based propellant: Double-based fuel/propellants consist of nitrocellulose with nitroglycerin or other liquid organic nitrate explosives added. Stabilizers and other additives are also used.

35. Triple-based propellant: Triple-based fuel/propellants consist of nitrocellulose, nitroguanidine, nitroglycerin or other liquid organic nitrate explosives.

36. Composite propellant: Examples include: 1) metallic aluminum, a combustible binder and an oxidizer such as ammonium perchlorate, 2) nitroglycerin with aluminum and ammonium perchlorate composite.

Propellants must be carefully designed and or selected for use. The downhole environment of oil and gas may consist of extremely high temperatures that can cause propellants to decay, or potentially self-ignite. The operating temperatures of oil and gas wells can vary from 75° C. to 230° C., for example. Another parameter that contributes to the careful design and selection of propellants is the energy that may be created by the propellant when ignited. High energy propellants may have too much energy for the system to handle and may cause irreparable damage to the barrel. The IPG system, due to the design of the interlocking barrel, does, however, handle significantly higher energy and pressure created by the ignition of high energy propellants. An embodiment of the IPG System may be capable of performing consistently and adequately with high pressures created by the ignition of any of the disclosed propellants. The range of pressure that an embodiment of the IPG System may be capable of withstanding, while still maintaining its functionality and reusability, may be in the range of 50,000 PSI to 135,000 PSI. This wide range enables flexibility in the design and selection of propellants for using an embodiment of the IPG system in downhole perforation operations in oil and gas wells.

Example Penetrators for One or More Embodiments

Penetrators may be bullets that are designed to penetrate, but not limited to, dense, hard, and heavy materials, and or alloys, by utilizing high-velocity and high-density penetrators that may overcome the materials protective properties. The materials used in penetrators, or bullets, can vary widely depending on the specific design and intended use.

Below are listed examples of a few existing types of penetrators, or bullets, that may be used in an IPG System and the materials commonly used to manufacture them:

1. Full Metal Jacket Armor Piercing (FMJ-AP) Bullets: FMJ-AP bullets typically feature a hardened steel penetrator encased in a copper or brass jacket. The jacket helps to provide some degree of protection to the bullet and can also help to reduce friction as it passes through the barrel. The steel penetrator is typically made from a high-strength steel alloy, such as tungsten or molybdenum.

2. Saboted Light Armor Penetrator (SLAP) Bullets: SLAP bullets utilize a lightweight, high-velocity penetrator made from materials such as tungsten or depleted uranium. The penetrator is encased in a lightweight plastic sabot that falls away after the bullet exits the barrel. This allows the penetrator to maintain its high velocity and penetrate armor more effectively.

3. Discarding Sabot Armor Piercing (DSAP) Bullets: DSAP bullets use a similar design to SLAP bullets but feature a heavier penetrator and a thicker sabot. The sabot falls away after leaving the barrel, exposing the heavy penetrator. This design allows for greater penetration power and improved accuracy.

4. Armor-Piercing Incendiary (API) Bullets: API bullets feature a hardened steel penetrator encased in a copper or brass jacket, with an incendiary compound in the tip of the bullet. The incendiary compound is designed to ignite upon impact, creating a secondary fire source that can ignite fuel or other flammable materials. The steel penetrator is typically made from a high-strength steel alloy, such as tungsten or molybdenum.

5. Armor-Piercing Fin-Stabilized Discarding Sabot (APFSDS) Bullets: APFSDS bullets use a long, thin penetrator made from a high-strength steel alloy such as tungsten or depleted uranium. The penetrator is encased in a lightweight sabot with fins to stabilize the bullet in flight. The sabot falls away after the bullet exits the barrel, allowing the penetrator to maintain its high velocity and penetrate armor more effectively.

Due to the flexibility of the IPG System, it may easily handle customizable penetrators that are not commonly used, or currently existing. Customizable penetrators may include, but not limited to, different shapes, the use of exotic alloys and non-exotic alloys, different diameters, different lengths, sabot bearing penetrators, non-sabot bearing penetrators, as well as penetrators with various geometries and design features that may be machined into, etched, ground, chiseled, or printed into the penetrator. Many factors may be considered when choosing an existing, and or customizable, penetrator to use with an IPG System. Existing, and or customizable, penetrators may be selected by an end user, and or operator, based on, but not limited to, performance and, but not limited to, the penetration depths, hole size, hole diameter, hole quality, hole consistency, and hole geometries in the casing that the penetrator may make when perforating.

The penetrators may also act as the sealing barrier between the well environment and the propellant chamber. Keeping the propellant dry and uncontaminated byfluids or debris while in the wellbore. The penetrator may be, but not limited to, configured with an O-ring style seal around its outside diameter, a sealing, and or non-sealing sabot, a gasket seal that may be polymer or alloy that may be incorporated between the penetrator and the barrel or between the penetrator, or sabot, and the propellant chamber. Materials that may be used as a sealing material other than polymer, epoxy, or ceramic may be, but are not limited to:

Lead Seal: Lead may be used as a seal due to its malleability, which allows it to conform to the rifling inside the barrel and create a better gas seal. Additionally, lead has a low melting point, which helps to reduce barrel fouling and improve overall performance.

Babbitt Seal: Babbitt alloy may be used as a seal for its low friction and self-lubricating properties, which reduces barrel wear and fouling. Additionally, its softness allows it to conform to the rifling inside the barrel, creating a better gas seal and improving accuracy.

The penetrator may also be potted, or bonded, in place to the barrel. This may consist of a, but not limited to, ceramic, glass or epoxy seal that is incorporated or bonded to the penetrator and the barrel. Epoxies that may be used, but not limited to:

Epoxy Phenolic: Epoxy Phenolic is a type of thermosetting resin that is highly resistant to high temperatures, chemicals, and mechanical stress.

Epoxy Novolac: Epoxy Novolac is another type of thermosetting resin that is highly resistant to high temperatures and chemicals.

Epoxy Vinyl Ester: Epoxy Vinyl Ester is a type of thermosetting resin that is highly resistant to high temperatures, chemicals, and mechanical stress.

Epoxy Polyurethane: Epoxy Polyurethane is a type of thermosetting resin that is highly resistant to high temperatures and mechanical stress.

Epoxy Acrylate: Epoxy Acrylate is a type of thermosetting resin that is highly resistant to high temperatures and mechanical stress.

The penetrator may also be designed and manufactured with a hole, or channel, through it. The hole may be located center, or off center of the penetrator and may be a smooth hole or threaded hole. The hole through the penetrator may act as a channel to run one, or many, electrical wires through. The electrical wire will connect to a, but not limited to, electric primer or other ignition device that is located within or below the, but not limited to, penetrator, sabot, or propellant chamber. Due to the flexibility of the IPG System, a wire may also run down the side of the barrel and penetrator to the electric primer or ignition device.

In terms of materials used, the penetrators used in the IPG System may comprise, but are not limited to:

Tungsten Alloys: Tungsten alloys may be used in penetrators due to their high density, high melting point, and high tensile strength. They can be further strengthened through heat treatments such as sintering, which involves compacting the tungsten powder and then heating it to high temperatures to bond the particles together. Common tungsten alloys used in penetrators include tungsten-carbide cobalt (WC—Co) and tungsten-nickel-iron (W—Ni—Fe).

Maraging Steel Alloys: Maraging steel alloys are a type of high-strength, low-alloy steel that can be hardened through heat treatment. They have high tensile strength and toughness. Maraging steel is typically made from a combination of iron, nickel, cobalt, and molybdenum. The steel is heat-treated at high temperatures and then rapidly cooled to form a martensitic structure, which provides additional strength and hardness.

Depleted Uranium: Depleted uranium is a byproduct of the uranium enrichment process and may be used in penetrators due to its high density and effectiveness to penetrate or perforate pipe, or casing. Depleted uranium is particularly effective at piercing heavy wall material and alloys due to its high density, which allows it to maintain its kinetic energy and penetrate more deeply. It is often combined with other materials such as tungsten to create a composite penetrator.

Beryllium Copper Alloys: Beryllium copper alloys are a type of copper alloy that includes beryllium as a primary alloying element. Beryllium copper has high strength and excellent thermal conductivity.

Cobalt-Chromium-Molybdenum (CoCrMo) Alloys: CoCrMo alloys may be used in penetrators due to their high tensile strength and resistance to wear and corrosion. CoCrMo alloys are typically made from a combination of cobalt, chromium, and molybdenum, and can be further strengthened through heat treatment.

Steels and Alloys Containing Elements such as, but not limited to, Carbon, Nickel, Vanadium, Chromium, Silicon, Molybdenum, Cobalt, Titanium, and Iron may also be used in conjunction with each other, or with the above listed materials for penetrators.

Other materials include, but not limited to, ceramic materials. Ceramic materials such as boron carbide and silicon carbide may be used in penetrators to provide additional hardness and penetration power. These materials are particularly effective at penetrating heavy wall made from composite materials. Molybdenum is another high-strength, dense metal that may be used in penetrators. It is particularly effective at penetrating heavy wall made from materials such as titanium.

When one embodiment of the IPG system is utilizing a sabot along with the penetrator, the sabot materials may comprise:

Brass: Brass may be used for sabots due to its high strength, good corrosion resistance, and ease of machining.

Aluminum: Aluminum is lightweight, strong, and has a low coefficient of friction.

Ceramics: Ceramics such as, but not limited to, aluminum oxide, boron carbide, and silicon carbide are very hard and can provide excellent resistance to penetration.

Polymers: Polymers such as nylon, polyester, and polycarbonate

Alloys: Various alloys, including aluminum alloys, steel, and titanium, can be used to make sabots.

Lead Sabot: Lead may be a material used for sabots due to its high density and malleability. The high density of lead may allow for a more efficient transfer of energy from the propellant to the projectile, resulting in increased velocity and penetration. The malleability of lead allows the sabot to conform to the barrel, creating a better gas seal and improving accuracy. Additionally, lead has a low melting point, which helps to reduce barrel fouling and improve overall performance.

Babbitt Alloy Sabot: Babbitt alloy is a soft, white metal alloy that may be desirable for manufacturing a sabot for its low friction and self-lubricating properties, which reduces barrel wear and fouling. Additionally, its softness allows it to conform to the inside the barrel, creating a better gas seal and improving accuracy. The low melting point of Babbitt alloy also reduces the risk of barrel fouling and allows for easier cleaning after use.

Polyethylene (PE): A widely used plastic known for its strength, toughness, and chemical resistance.

Polypropylene (PP): A versatile plastic with high chemical resistance, low density, and good thermal stability.

Polycarbonate (PC): A strong and transparent plastic with good impact resistance.

Acrylic (PMMA): A clear plastic with excellent optical properties and weather resistance.

Nylon (PA): A strong and durable plastic with good chemical resistance. Nylon is used in applications such as automotive parts, gears, and bearings.

PEEK: PEEK is known for its high strength, stiffness, and temperature resistance.

ULTEM: ULTEM is a thermoplastic that offers high strength, stiffness, and temperature resistance with excellent flame retardancy.

Composites: Composites are materials made by combining two or more materials with different properties to create a material with enhanced properties. For example, a composite material made from carbon fibers and epoxy resin can offer high strength and low weight.

Example materials and post processing techniques for an IPG System gun body

High-strength steels: Steel alloys with high tensile strength and yield strengths may be used to manufacture the IPG System bodies. The specific composition of these steels can vary depending on the intended use, but they typically contain elements such as carbon, manganese, and chromium, which improve strength and durability.

Chrome-Molybdenum Steel: Also known as chromoly steel, this type of steel is an alloy of iron, carbon, chromium, and molybdenum. It has excellent strength and durability, as well as resistance to wear and corrosion, which may make it an ideal alloy for the IPG System bodies.

4140: This is a medium-carbon, chromium-molybdenum alloy steel that has high tensile strength, excellent fatigue resistance, and good wear resistance. The chemical composition of 4140 steel typically includes the following elements: Carbon (C): 0.38-0.43%; Manganese (Mn): 0.75-1.00%; Phosphorus (P): 0.035% max; Sulfur (S): 0.040% max; Silicon (Si): 0.15-0.35%; Chromium (Cr): 0.80-1.10%; and Molybdenum (Mo): 0.15-0.25%. In addition to these primary elements, 4140 steel may also contain small amounts of other alloying elements such as nickel, copper, and vanadium, which can further enhance its mechanical properties.

4130: This is a low-alloy steel that contains chromium and molybdenum, as well as smaller amounts of other alloying elements such as carbon, manganese, and silicon. It is known for its high strength, toughness, and fatigue resistance. The chemical composition of 4130 steel typically includes the following elements: Carbon (C): 0.28-0.33%; Manganese (Mn): 0.40-0.60%; Phosphorus (P): 0.035% max; Sulfur (S): 0.040% max; Silicon (Si): 0.15-0.35%; Chromium (Cr): 0.80-1.10%; and, Molybdenum (Mo): 0.15-0.25%. As with 4140 steel, 4130 steel may also contain small amounts of other alloying elements such as nickel, copper, and vanadium, which can further enhance its mechanical properties.

4330 Vanadium Modified: This is a type of high-strength, low-alloy steel that has been modified with the addition of vanadium to enhance its mechanical properties. It is commonly used in the manufacture of high-stress component. The chemical composition of 4330 Vanadium Modified steel typically includes the following elements: Carbon (C): 0.28-0.33%; Manganese (Mn): 0.70-0.90%; Silicon (Si): 0.15-0.35%; Chromium (Cr): 0.80-1.10%; Molybdenum (Mo): 0.25-0.35%; and Vanadium (V): 0.10-0.15%

4340: This is a nickel-chromium-molybdenum alloy steel that has high tensile strength, good toughness, and excellent fatigue resistance, which may make it an ideal alloy for the IPG System bodies. The chemical composition of 4340 steel typically includes the following elements: Carbon (C): 0.38-0.43%; Manganese (Mn): 0.60-0.80%; Phosphorus (P): 0.035% max; Sulfur (S): 0.040% max; Silicon (Si): 0.15-0.35%; Chromium (Cr): 0.70-0.90%; Nickel (Ni): 1.65-2.00%; and, Molybdenum (Mo): 0.20-0.30%. In addition to these primary elements, 4340 steel may also contain small amounts of other alloying elements such as vanadium, which can further enhance its mechanical properties.

4150: This is a low-alloy steel that contains chromium and molybdenum, as well as small amounts of carbon and other alloying elements. It is known for its high strength, toughness, and wear resistance. The chemical composition of 4150 steel typically includes the following elements: Carbon (C): 0.48-0.53%; Manganese (Mn): 0.75-1.00%; Phosphorus (P): 0.035% max; Sulfur (S): 0.040% max; Silicon (Si): 0.15-0.35%; Chromium (Cr): 0.80-1.10%; and Molybdenum (Mo): 0.15-0.25%. As with other low-alloy steels, 4150 steel may also contain small amounts of other alloying elements such as nickel, copper, and vanadium, which can further enhance its mechanical properties.

8620: This is a low-alloy steel that contains chromium, molybdenum, and nickel, as well as smaller amounts of carbon and other alloying elements. It is known for its high strength, toughness, and wear resistance. The chemical composition of 8620 steel typically includes the following elements: Carbon (C): 0.18-0.23%; Manganese (Mn): 0.70-0.90%; Phosphorus (P): 0.035% max; Sulfur (S): 0.040% max; Silicon (Si): 0.15-0.35%; Chromium (Cr): 0.40-0.60%; Nickel (Ni): 0.40-0.70%; and Molybdenum (Mo): 0.15-0.25%. In addition to these primary elements, 8620 steel may also contain small amounts of other alloying elements such as vanadium and cobalt, which can further enhance its mechanical properties.

Stainless Steel: Stainless steel is an alloy of iron, carbon, and a minimum of 10.5% chromium. It is known for its high strength, durability, and resistance to corrosion, which may make it an ideal material used to manufacture the IPG System bodies.

Martensitic stainless steels: Martensitic stainless steels are the strongest and hardest of all the stainless steels, thanks to their high carbon content and the ability to be heat-treated to increase their strength. They typically contain between 12% and 18% chromium, and can also contain small amounts of other alloying elements such as nickel and molybdenum.

400 series: The 400 series martensitic stainless steels typically contain between 11.5% and 18% chromium, and can also contain varying amounts of other alloying elements such as nickel, molybdenum, and carbon.

440: Type 440 is a high-carbon martensitic stainless steel that contains 16% to 18% chromium, and can also contain small amounts of other elements such as nickel, molybdenum, and carbon.

440C: This is a high-carbon martensitic stainless steel that has a high hardness, wear resistance, and corrosion resistance, as well as a high tensile and yield strength.

420: This is a high-carbon martensitic stainless steel that has a high hardness, wear resistance, and corrosion resistance, as well as a high tensile and yield strength.

410: This is a basic martensitic stainless steel that has a high strength, good corrosion resistance, and a high tensile and yield strength.

17-4 PH: Also known as 630, this is a precipitation-hardening martensitic stainless steel that has a high strength, good corrosion resistance, and a high tensile and yield strength.

15-5 PH: This is a precipitation-hardening martensitic stainless steel that has a high strength, good corrosion resistance, and a high tensile and yield strength.

Post processing that may be, but not limited to, performed on Martensitic stainless steels which may be a material used to manufacture an Interlocking Gun:

Example post processing that may be performed on chrome-molybdenum steels, and other materials, used to manufacture an interlocking gun include: Quench and tempering: This is a two-step process that involves quenching the steel from a high temperature to rapidly cool it, followed by tempering at a lower temperature to achieve the desired mechanical properties. The quenching step rapidly cools the steel to create a high-strength, hard material, while the tempering step allows the material to retain some toughness and ductility.

Nitriding: Nitriding is a surface treatment that involves exposing the steel to nitrogen gas at high temperatures to diffuse nitrogen into the surface of the material. This creates a hard, wear-resistant surface layer that can improve the fatigue strength and wear resistance of the material.

Carburizing: Carburizing is a surface treatment that involves exposing the steel to a carbon-rich environment at high temperatures to diffuse carbon into the surface of the material. This creates a hard, wear-resistant surface layer that can improve the fatigue strength and wear resistance of the material.

Shot peening: Shot peening is a process that involves bombarding the surface of the steel with small, high-velocity metal or ceramic beads to create compressive stresses on the surface of the material. This can improve the fatigue strength of the material by reducing the likelihood of surface cracks propagating into the material.

Welding: Welding can be used to join different parts of the steel together, but it can also be used to enhance the mechanical properties of the material. Welding can create a localized heat-affected zone that can increase the strength of the material in that area, but it can also introduce residual stresses and reduce the toughness of the material if not done properly.

Quenching: The quenching process involves rapidly cooling the steel from a high temperature in a quenching medium, typically oil or water. This process causes the austenite phase to transform into a martensite phase, resulting in an increase in strength and hardness.

Tempering: Tempering is a process of reheating the steel to a lower temperature after it has been quenched. This process relieves some of the internal stresses caused by the quenching process, resulting in a reduction in brittleness and an increase in ductility. Tempering also helps to achieve a specific combination of strength and toughness.

Nitriding: Nitriding is a surface hardening process that involves introducing nitrogen into the surface of the steel. This process increases surface hardness and wear resistance, while maintaining the toughness of the steel.

Austempering: Austempering is a heat treatment process that involves quenching the steel in a molten salt bath at a specific temperature. This process results in the formation of a bainitic microstructure, which has higher strength and toughness than a martensitic microstructure.

Martempering: Martempering is a heat treatment process that involves quenching the steel in a molten salt bath, followed by air cooling. This process produces a tempered martensite microstructure, which has high strength and toughness.

Cryogenic treatment: Cryogenic treatment is a process that involves exposing the steel to very low temperatures, typically below −150° C., for an extended period of time. This process helps to relieve residual stresses and increase the uniformity of the steel's microstructure, resulting in improved strength, toughness, and wear resistance.

Precipitation hardening (PH) stainless steels: PH stainless steels can be heat-treated to achieve a combination of high strength and excellent corrosion resistance. They contain relatively high levels of chromium (16-20%) and nickel (3-13%), as well as small amounts of other alloying elements such as copper, molybdenum, and titanium.

17-4 PH: Also known as 630 stainless steel, 17-4 PH is a martensitic precipitation hardening stainless steel that contains chromium, nickel, and copper. It is known for its excellent combination of high strength, corrosion resistance, and toughness.

15-5 PH: Also known as XM-12 or AK Steel 15-5, 15-5 PH is a martensitic precipitation hardening stainless steel that contains chromium, nickel, and copper. It has high strength, good toughness, and excellent corrosion resistance.

13-8 PH: Also known as UNS S13800, 13-8 PH is a precipitation hardening stainless steel that contains chromium, nickel, and molybdenum. It has high strength and excellent corrosion resistance, as well as good toughness.

Custom 450: Custom 450 is a precipitation hardening stainless steel that contains chromium, nickel, and molybdenum. It has high strength, good toughness, and excellent corrosion resistance.

Custom 455: Custom 455 is a precipitation hardening stainless steel that contains chromium, nickel, and molybdenum. It has high strength, good toughness, and excellent corrosion resistance.

PH 13-8 Mo: PH 13-8 Mo is a precipitation hardening stainless steel that contains chromium, nickel, molybdenum, and cobalt. It has high strength, good toughness, and excellent corrosion resistance, as well as good fatigue resistance.

PH 17-7: PH 17-7 is a precipitation hardening stainless steel that contains chromium, nickel, and aluminum. It has high strength, good toughness, and excellent corrosion resistance.

Post processing that may be performed on PH stainless steels which may be a material used to manufacture an interlocking gun according to an embodiment:

Solution annealing: This is the first step in the heat treatment process for PH stainless steels. The steel is heated to a temperature above its austenitic range and then cooled rapidly to room temperature. This process helps to dissolve any precipitated phases in the steel, making it more ductile and easier to work with.

Aging: Aging is the second step in the heat treatment process for PH stainless steels. The steel is heated to a specific temperature and held for a specific period of time, allowing for the precipitation of fine particles of the strengthening phase. This process can be done at different temperatures and for different lengths of time to achieve the desired mechanical properties.

Cold working: Cold working can be used to increase the strength and hardness of PH stainless steels. This process involves deforming the steel at a temperature below its recrystallization temperature. Cold working can be done through processes such as rolling, forging, or drawing.

Stress relieving: Stress relieving is a process that is often used after cold working to remove residual stresses in the steel. The steel is heated to a temperature below its austenitic range and then cooled slowly. This process can help to reduce the risk of stress corrosion cracking and other types of cracking.

Tempering: Tempering is a process that can be used to adjust the properties of PH stainless steels. The steel is heated to a specific temperature and held for a specific period of time, then cooled slowly. This process can be used to reduce the hardness and increase the ductility of the steel, making it easier to work with.

Austenitic stainless steels: Austenitic stainless steels are the most common type of stainless steel, and while they are not as strong as martensitic or PH stainless steels, they still have good strength and excellent corrosion resistance. They contain relatively high levels of chromium (16-28%) and nickel (6-20%), as well as small amounts of other alloying elements such as molybdenum and nitrogen.

Nitronic 50 (UNS S20910): This is a high-strength austenitic stainless steel that contains nitrogen, manganese, and nickel. Nitronic 50 is known for its excellent corrosion resistance, high tensile and yield strengths, and good ductility.

Nitronic 60 (UNS S21800): This is another high-strength austenitic stainless steel that contains nitrogen, chromium, and nickel. Nitronic 60 has similar properties to Nitronic 50, but is more resistant to wear and galling.

Precipitation-hardening austenitic stainless steels: Some austenitic stainless steels can be strengthened through precipitation hardening, which involves the formation of fine particles of a strengthening phase within the steel. Some examples of precipitation-hardening austenitic stainless steels include PH 17-4, PH 15-7, and Custom 450.

Super-austenitic stainless steels: Super-austenitic stainless steels are highly alloyed austenitic stainless steels that have excellent corrosion resistance and good strength. Some examples of super-austenitic stainless steels include AL-6XN (UNS N08367), 254 SMO (UNS S31254), and 904L (UNS N08904).

Cold-worked austenitic stainless steels: Austenitic stainless steels can also be strengthened through cold working, which involves deforming the steel at a temperature below its recrystallization temperature. This process increases the strength and hardness of the steel, but can also reduce its ductility. Some examples of cold-worked austenitic stainless steels include 301, 302, and 304.

Post processing that may be performed on austenitic stainless steels which may be a material used to manufacture an interlocking gun according to one embodiment:

Cold working: Austenitic stainless steels can be strengthened through cold working, which involves deforming the steel at a temperature below its recrystallization temperature. This process increases the strength and hardness of the steel, but can also reduce its ductility. Cold working can be done through processes such as rolling, drawing, or pressing.

Solution annealing and quenching: Solution annealing is a heat treatment process that involves heating the steel to a high temperature, typically around 1050-1150° C., and then cooling it rapidly by quenching it in water or oil. This process dissolves any carbides or intermetallic compounds that may have formed in the steel and restores its ductility. Quenching the steel rapidly from the solution annealing temperature can also increase its strength.

Precipitation hardening: Some austenitic stainless steels can be strengthened through precipitation hardening, which involves the formation of fine particles of a strengthening phase within the steel. This is typically achieved through a two-step heat treatment process: first, the steel is solution annealed to dissolve any carbides or intermetallic compounds, and then it is aged at a lower temperature to allow the precipitation of the strengthening phase. The precipitation hardening process can increase the strength of austenitic stainless steels while maintaining their ductility.

Work hardening: Austenitic stainless steels can also be strengthened through work hardening, which involves deforming the steel through cold working, hot working, or machining. This process increases the dislocations within the steel, which increases its strength and hardness. Work hardening can also improve the wear resistance of austenitic stainless steels.

Duplex stainless steels: Duplex stainless steels are a combination of austenitic and ferritic stainless steels, and have a unique microstructure that gives them a good combination of strength and corrosion resistance. They typically contain between 18% and 28% chromium, and between 4% and 8% nickel, as well as small amounts of other alloying elements such as molybdenum and nitrogen.

Lean duplex: This is a lower alloyed grade of duplex stainless steel, with a balanced composition of austenite and ferrite. It typically contains around 22-23% chromium, 0.3-0.5% molybdenum, and 4-6% nickel, with low carbon and nitrogen levels.

Standard duplex: This is a medium alloyed grade of duplex stainless steel, with a slightly higher chromium and molybdenum content than lean duplex. It typically contains around 22-23% chromium, 2.5-3.5% molybdenum, and 4-6% nickel, with low carbon and nitrogen levels.

Super duplex: This is a higher alloyed grade of duplex stainless steel, with a higher chromium and molybdenum content than standard duplex. It typically contains around 24-26% chromium, 3-5% molybdenum, and 6-8% nickel, with low carbon and nitrogen levels.

Hyper duplex: This is a very high alloyed grade of duplex stainless steel, with a very high chromium and molybdenum content. It typically contains around 30-35% chromium, 4-6% molybdenum, and 7-9% nickel, with low carbon and nitrogen levels.

Post processing that may be, but not limited to, performed on Duplex stainless steels which may be a material used to manufacture an Interlocking Gun: Solution annealing: This process involves heating the material to a high temperature and then quenching it in water or oil. It helps to dissolve any carbides or other impurities in the material and makes it more homogenous.

Aging: Aging is a process of heat treatment that involves heating the material to a specific temperature and holding it for a certain period of time. It helps to precipitate the carbides and other strengthening elements in the material, which increases its strength and hardness.

Cold working: Cold working involves deforming the material at a temperature below its recrystallization temperature. It helps to increase the material's strength and hardness by inducing dislocations and other defects in the crystal structure.

Shot peening: Shot peening is a process of bombarding the material with small steel or ceramic particles at high velocity. It helps to induce compressive stresses in the surface layer of the material, which improves its fatigue strength and resistance to stress corrosion cracking.

Electro-polishing: Electro-polishing is a process of removing a thin layer of material from the surface of the material using an electrolyte solution. It helps to improve the surface finish of the material, which reduces the risk of corrosion and improves its fatigue strength.

Maraging Steel: Maraging steel is a low-carbon, high-nickel alloy that is heat-treated to achieve high strength and toughness. It is known for its excellent resistance to corrosion and stress corrosion cracking, as well as its ability to withstand high temperatures, which may make it an ideal material for manufacturing the IPG System bodies.

Maraging 200 (18Ni-200): This is a low-carbon maraging steel that contains 18% nickel and is known for its high strength and toughness. The chemical composition of Maraging 200 (18Ni-200) typically includes the following elements: Nickel (Ni): 18.0%; Cobalt (Co): 8.0%; Molybdenum (Mo): 4.9%; Titanium (Ti): 0.4%; Aluminum (Al): 0.1%; Carbon (C): 0.03%; Iron (Fe): Balance Maraging 250 (18Ni-250): This is a medium-carbon maraging steel that contains 18% nickel and is used in applications where higher strength is required. The chemical composition of Maraging 250 (18Ni-250) typically includes the following elements: Nickel (Ni): 17.0-19.0%; Cobalt (Co): 7.8-8.8%; Molybdenum (Mo): 4.6-5.2%; Titanium (Ti): 0.3-0.6%; Aluminum (Al): 0.05-0.15%; Carbon (C): 0.03% max; Iron (Fe): balance.

Maraging 300 (18Ni-300): This is a high-carbon maraging steel that contains 18% nickel and is known for its high strength and hardness. The chemical composition of Maraging 300 (18Ni-300) typically includes the following elements: Nickel (Ni): 18.0-19.5%; Cobalt (Co): 8.5-9.5%; Molybdenum (Mo): 4.8-5.2%; Titanium (Ti): 0.5-0.8%; Aluminum (Al): 0.05-0.15%; Carbon (C): 0.03% max; Iron (Fe): balance.

Maraging 350 (18Ni-350): This is a high-strength maraging steel that contains 18% nickel and is used in applications where high strength and toughness are required. The chemical composition of Maraging 350 (18Ni-350) typically includes the following elements: Nickel (Ni): 17.0-19.0%; Cobalt (Co): 12.0-13.5%; Molybdenum (Mo): 4.6-5.2%; Titanium (Ti): 0.3-0.6%; Aluminum (Al): 0.05-0.15%; Carbon (C): 0.03% max; Iron (Fe): balance Maraging 450 (18Ni-450): This is a very high-strength maraging steel that contains 18% nickel and is used in applications where extreme strength is required. The chemical composition of Maraging 450 (18Ni-450) typically includes the following elements: Nickel (Ni): 17.0-19.0%; Cobalt (Co): 7.8-8.8%; Molybdenum (Mo): 4.6-5.2%; Titanium (Ti): 0.3-0.6%; Aluminum (Al): 0.05-0.15%; Carbon (C): 0.03% max; Iron (Fe): balance.

Maraging 500 (18Ni-500): This is an ultra-high-strength maraging steel that contains 18% nickel and is used in applications such as aircraft landing gear and rocket motor cases. The chemical composition of Maraging 500 (18Ni-500) typically includes the following elements: Nickel (Ni): 17.0-19.0%; Cobalt (Co): 7.0-8.5%; Molybdenum (Mo): 4.6-5.2%; Titanium (Ti): 0.3-0.6%; Aluminum (Al): 0.05-0.15%; Carbon (C): 0.03% max; Iron (Fe): balance.

Post processing that may be, but not limited to, performed on maraging steels which may be a material used to manufacture an interlocking gun:

Solution Annealing: The first step in the manufacturing process is to subject the Maraging steel to a solution annealing treatment, which involves heating the steel to a high temperature between 760-900° C. and holding it there for a specific amount of time. This treatment dissolves any carbides or other precipitates that may have formed during the cooling of the steel after it was initially cast.

Aging: After the solution annealing, the Maraging steel is rapidly cooled to room temperature, and then subjected to a low-temperature aging treatment. This process involves heating the steel to a temperature range between 480-540° C. and holding it there for several hours. This promotes the precipitation of intermetallic compounds within the steel matrix, which increase its strength.

Double Aging: In some cases, a secondary aging process may be performed to achieve even higher strength levels. This involves performing the low-temperature aging treatment a second time, usually at a slightly higher temperature or for a longer duration than the first aging treatment.

Cold Working: Cold working, such as cold drawing, can be used to increase the tensile strength of Maraging steel. Cold working stretches and elongates the metal, which realigns its crystal structure, making it stronger.

Stress Relieving: Stress relieving is a post-treatment process that is performed on the Maraging steel to reduce the residual stresses present in the material. This process involves heating the steel to a low temperature (200-300° C.) and holding it for a specific duration to reduce stress and prevent cracking or distortion.

Carbon Steel: Carbon steel is a common type of steel alloy that is known for its high strength and durability. It contains varying amounts of carbon, which contributes to its strength and hardness, as well as other alloying elements like manganese, silicon, and copper, which improve its toughness and resistance to wear.

AISI 1045: A medium carbon steel with a tensile strength of around 600-800 MPa and yield strength of 355 MPa. The chemical composition of AISI 1045 typically includes the following elements: Carbon: 0.43-0.50%; Manganese: 0.60-0.90%; Phosphorus: 0.040% max; Sulfur: 0.050% max.

AISI 1050: A high carbon steel with a tensile strength of 615-950 MPa and yield strength of 440 MPa. The chemical composition of AISI 1050 typically includes the following elements: Carbon: 0.47-0.55%; Manganese: 0.60-0.90%; Phosphorus: 0.040% max; Sulfur: 0.050% max.

AISI 1095: A high carbon steel with a tensile strength of 710-1,280 MPa and yield strength of 275 MPa. The chemical composition of AISI 1095 typically includes the following elements: Carbon: 0.90-1.03%; Manganese: 0.30-0.50%; Phosphorus: 0.030% max; Sulfur: 0.030% max.

AISI 4140: A chromium-molybdenum steel with a tensile strength of 850-1,100 MPa and yield strength of 550 MPa. The chemical composition of AISI 4140 typically includes the following elements: Carbon: 0.38-0.43%; Chromium: 0.80-1.10%; Manganese: 0.75-1.00%; Phosphorus: 0.035% max; Sulfur: 0.040% max; Silicon: 0.15-0.35%; Molybdenum: 0.15-0.25%.

AISI 4340: A nickel-chromium-molybdenum steel with a tensile strength of 930-1,080 MPa and yield strength of 470 MPa. The chemical composition of AISI 4340 typically includes the following elements: Carbon: 0.38-0.43%; Chromium: 0.70-0.90%; Manganese: 0.60-0.80%; Phosphorus: 0.035% max; Sulfur: 0.040% max; Silicon: 0.15-0.35%; Nickel: 1.65-2.00%; Molybdenum: 0.20-0.30%.

AISI 52100: A high carbon, chromium alloyed steel commonly used for ball bearings, with a tensile strength of 550-685 MPa and yield strength of 295 MPa. The chemical composition of AISI 52100 typically includes the following elements: Carbon: 0.95-1.10%; Chromium: 1.30-1.60%; Manganese: 0.25-0.45%; Phosphorus: 0.025% max; Sulfur: 0.025% max; Silicon: 0.15-0.35%.

AISI 8620: A low carbon, nickel-chromium-molybdenum alloy steel with a tensile strength of 530-700 MPa and yield strength of 300 MPa. The chemical composition of AISI 8620 typically includes the following elements: Carbon: 0.18-0.23%; Chromium: 0.40-0.60%; Manganese: 0.70-0.90%; Phosphorus: 0.035% max; Sulfur: 0.040% max; Silicon: 0.15-0.35%; Nickel: 0.40-0.70%; Molybdenum: 0.15-0.25%.

Tool Steel: Tool steel is a high-carbon steel alloy that is designed to withstand high pressures and temperatures, as well as heavy use and wear. It is commonly used in the manufacture of gun barrels and other high-pressure components due to its excellent strength, toughness, and resistance to wear and corrosion.

Water-hardening tool steels (W-grade): W1, W2, W5, W6, W7, W10—these steels are characterized by their low alloy content and high carbon content, making them hard and wear-resistant.

Shock-resistant tool steels (S-grade): S1, S2, S5, S6, S7, S10, S30, S40, S45—these steels are designed to withstand sudden impact and high-stress conditions.

Hot-work tool steels (H-grade): H10, H11, H12, H13, H19, H21, H22, H23, H24, H25, H26, H42, H43, H44—these steels are specifically designed for use in high-temperature applications such as forging and extrusion.

Cold-work tool steels (D-grade): D2, D3, D4, D5, D6, D7, D8, D9, D10, D11, D12, D13, D4R—these steels are designed for use in applications where the material must be cut, shaped, or formed at room temperature.

High-speed tool steels (T-grade): T1, T2, T4, T5, T6, T7, T8, T9, T10, T11, T12, T15, T42, T113, M1, M2, M3, M4, M6, M7, M10, M30, M33—these steels are designed to operate at high speeds and temperatures, while retaining their strength and wear-resistance.

Powder-metallurgy tool steels: CPMS30V, CPMS35VN, CPMS90V, CPMRexT15, CPMRexM4, CPM10V, CPM3V, CPM9V, CPM15V, CPM154, CPM-S30V—these steels are manufactured using a powder metallurgy process, resulting in a high level of toughness and wear resistance.

Post processing that may be performed on tool steels which may be a material used to manufacture an interlocking gun:

Heat Treatment: Heat treatment is a common post-processing technique for tool steels. It involves heating the steel to a specific temperature and then cooling it at a controlled rate. The heat treatment can be used to improve the hardness, toughness, and strength of the steel.

Tempering: Tempering is a heat treatment process that is often used in conjunction with quenching. After the tool steel has been quenched to achieve maximum hardness, it is then tempered by reheating it to a lower temperature and holding it there for a period of time. This process improves the toughness and ductility of the steel.

Nitriding: Nitriding is a process in which the surface of the steel is treated with nitrogen gas to improve the surface hardness and wear resistance. It is commonly used for tool steels that require high wear resistance.

Cryogenic Treatment: Cryogenic treatment involves cooling the tool steel to a temperature of −120° C. to −196° C., holding it at that temperature for a period of time, and then gradually warming it up to room temperature. This process can improve the toughness, wear resistance, and dimensional stability of the steel.

Surface Coating: Surface coating can be used to improve the wear resistance and surface hardness of tool steels. Common coatings include TiN, TiCN, and AITiN.

Nickel-copper alloys: These materials, such as Monel and Inconel, are often used in the manufacture of artillery and other high-pressure components due to their high strength, toughness, and resistance to corrosion and high temperatures.

Monel: Monel is a series of nickel-copper alloys that have high strength, corrosion resistance, and other desirable properties. The most commonly used Monel alloys are:

Monel 400: This alloy is composed of approximately 67% nickel, 29% copper, and small amounts of iron, manganese, carbon, and silicon. It has high strength, excellent corrosion resistance, and good weldability.

Post processing that may be, but not limited to, performed on Monel 400 which may be a material used to manufacture an Interlocking Gun:

Heat Treatment: Monel 400 can be heat treated to improve its mechanical properties. This process involves heating the material to a specific temperature and then cooling it at a specific rate. Heat treatment can improve the alloy's strength, toughness, and ductility, while reducing its susceptibility to stress corrosion cracking.

Cold Working: Monel 400 can be cold worked to improve its strength and hardness. This process involves deforming the material at a low temperature, which can increase its strength and make it more resistant to wear and deformation. Cold working can also increase the material's yield strength.

Age Hardening: Monel 400 can be age hardened to increase its strength and hardness. This process involves heating the material to a specific temperature and then cooling it rapidly to room temperature, followed by heating it again at a lower temperature. Age hardening can improve the material's yield and tensile strengths, while also improving its fatigue resistance.

Shot Peening: Monel 400 can be shot peened to improve its fatigue resistance and increase its strength. This process involves bombarding the surface of the material with small spherical particles at high velocities. Shot peening can also reduce stress concentrations and improve the material's resistance to stress corrosion cracking.

Monel K500: This alloy is a precipitation-hardening nickel-copper alloy that contains about 63% nickel, 30% copper, and small amounts of aluminum and titanium. It has high strength and excellent corrosion resistance, which may make it an ideal material for manufacturing the IPG System bodies. Post processing that may be performed on Monel K500 which may be a material used to manufacture an Interlocking Gun:

Solution Annealing: Monel K500 is solution annealed by heating it to a temperature range of 1000-1200° C. for a specific time period, followed by rapid cooling in water. This process removes any residual stresses that may be present in the material due to the manufacturing process and also dissolves any intermetallic compounds that may be present.

Age Hardening: After solution annealing, Monel K500 is aged by heating it to a temperature range of 480-550° C. for a specific time period, followed by air cooling. This process promotes the precipitation of intermetallic compounds, such as gamma prime (Ni3Al) and gamma double prime (Ni3Nb), which significantly improve the material's strength and hardness. The amount of aging time depends on the required strength level, and it can be varied to achieve the desired properties.

Cold Working: Monel K500 can also be cold worked to increase its strength and hardness. Cold working is a process that involves deforming the material at room temperature by rolling, drawing, or pressing. This process causes dislocations in the crystal structure, which strengthens the material by impeding the movement of defects through the metal.

Stress Relieving: Monel K500 can also undergo stress relieving, which is a heat treatment process used to reduce internal stresses that may have been induced during cold working or machining. The process involves heating the material to a temperature range of 400-500° C. for a specific time period, followed by slow cooling in a furnace. Stress relieving does not significantly affect the material's strength, but it does improve its ductility and toughness by reducing residual stresses.

Monel R405: This alloy is a free-machining version of Monel 400, and is composed of approximately 67% nickel and 30% copper, with small amounts of iron and manganese. Post processing that may be performed on Monel R405 which may be a material used to manufacture an interlocking gun:

Heat Treatment: The heat treatment involves a solution annealing process, which involves heating the alloy to a high temperature to dissolve any precipitated phases and create a uniform microstructure. This is followed by rapid cooling or quenching to maintain the desired properties. After solution annealing, Monel R405 may be further aged to increase strength and hardness.

Cold Working: Cold working Monel R405, such as rolling or drawing, which can increase its strength and ductility. Cold working induces plastic deformation in the alloy, creating dislocations that can act as barriers to dislocation motion and increase the yield strength. However, excessive cold working can also make the material brittle, so the degree of cold working must be carefully controlled.

Shot Peening: Shot peening is a process that bombards the surface of the alloy with small metal or ceramic beads to induce compressive stresses, which can improve its fatigue resistance.

Electropolishing: Electropolishing is a chemical treatment that removes a thin layer of material from the surface, improving its finish and reducing the likelihood of surface defects.

Monel 404: This alloy contains about 52% nickel and 48% copper, and is often used in electrical and electronic applications. Post processing that may be performed on Monel 404 which may be a material used to manufacture an interlocking gun:

Heat treatment: Monel 404 can be heat treated to increase its strength. The heat treatment process involves heating the material to a specific temperature for a specific time, and then cooling it down slowly. This process can increase the yield strength and tensile strength of the material.

Cold working: Cold working, also known as work hardening, is another process that can increase the strength of Monel 404. The process involves deforming the material at room temperature, which increases its strength. However, overworking can lead to brittleness, so it must be carefully controlled.

Aging: Aging is a process in which Monel 404 is heated to a specific temperature and held for a certain amount of time. This allows the alloying elements to diffuse and form small precipitates within the material, which can increase its strength.

Shot peening: Shot peening is a mechanical process that involves blasting the surface of the material with small, high-velocity particles. This process can increase the strength and fatigue resistance of Monel 404 by inducing compressive stresses on the surface, which can help prevent crack propagation.

Monel 401: This alloy contains about 42% nickel and 58% copper, and is primarily used in electrical and electronic applications. Post processing that may be performed on Monel 401 which may be a material used to manufacture an interlocking gun:

Age Hardening: Monel 401 can be age-hardened by heating the alloy at a specific temperature and holding it for a specific time. This process increases the strength of the material by precipitating small particles of a second phase within the microstructure.

Cold Working: Monel 401 can be cold worked to increase its strength. Cold working involves deforming the material at room temperature, which changes the microstructure and increases the material's yield strength.

Annealing: Annealing is a heat treatment process used to reduce the hardness of the material and increase its ductility. Monel 401 can be annealed by heating the alloy to a specific temperature and holding it for a specific time, then slowly cooling it. This process can help remove any residual stresses in the material and increase its ductility.

Stress Relieving: Stress relieving is a heat treatment process used to reduce the residual stresses in the material after it has been cold worked. The material is heated to a specific temperature and held for a specific time, then slowly cooled. This process helps improve the material's mechanical properties and reduces the risk of cracking or failure during use.

Monel 450: This alloy contains about 70% nickel, 29% copper, and small amounts of iron and manganese. It has high strength and excellent corrosion resistance, and is often used in marine environments. Post processing that may be performed on Monel 450 which may be a material used to manufacture an interlocking gun:

Solution Annealing: Monel 450 is heated to a high temperature (usually around 1020° C.) and held at that temperature for a specific amount of time to dissolve the alloying elements and produce a homogenous microstructure. The alloy is then rapidly cooled, usually by quenching in water, to retain the desired microstructure.

Age Hardening: After solution annealing, Monel 450 is allowed to cool to room temperature, and then subjected to a series of heat treatments to precipitate and harden the alloying elements. This process is known as age hardening or precipitation hardening, and it results in increased strength and hardness.

Cold Working: Monel 450 can be cold worked to increase its strength and hardness while retaining its excellent ductility. Cold working can be performed by processes such as rolling, forging, and drawing.

Surface Treatment: Surface treatments, such as shot peening or electropolishing, can be applied to Monel 450 to improve its fatigue resistance and to remove any surface defects or imperfections. These treatments do not affect the material's mechanical properties but can improve its longevity and resistance to environmental factors.

Alloy K-500: Alloy K-500 is a nickel-copper alloy that is precipitation hardened to achieve high tensile and yield strengths. It is also sometimes referred to as Monel K-500, which is a trademarked name for this specific alloy. The chemical composition of Alloy K-500 typically includes the following elements: Nickel (Ni): 63.0-70.0%; Copper (Cu): 27.0-33.0%; Aluminum (Al): 2.30-3.15%; Titanium (Ti): 0.35-0.85%; Iron (Fe): 2.0% max; Manganese (Mn): 1.5% max; Silicon (Si): 0.5% max; Carbon (C): 0.25% max; Sulfur (S): 0.010% max.

Post processing that may be performed on Alloy K-500 which may be a material used to manufacture an interlocking gun:

Heat Treatment: Heat treatment is one of the primary post-processing steps used to increase the strength of Alloy K-500. The alloy is first solution annealed at a temperature of around 1900° F. for about 1 hour to dissolve any copper-rich phases in the material. It is then rapidly quenched to room temperature to form a supersaturated solid solution. The alloy is then aged at a lower temperature of around 900-1000° F. for a few hours to precipitate a fine dispersion of gamma prime (Ni3Al) particles throughout the material, which provides strength to the alloy.

Cold Working: Cold working or cold rolling is another method used to increase the strength of Alloy K-500. The alloy can be cold worked by rolling, bending, or drawing the material at room temperature. This process causes the grains of the alloy to elongate, increasing the density of dislocations in the material, which results in an increase in strength.

Shot Peening: Shot peening is a surface treatment process that is used to increase the fatigue strength of Alloy K-500. In this process, small steel balls are blasted onto the surface of the material at high velocity. This causes a compressive residual stress in the surface layer, which improves the fatigue strength of the material.

Age Hardening: Age hardening is a process used to increase the strength of Alloy K-500 by precipitating fine gamma prime particles within the material. The alloy is first solution annealed and rapidly quenched to form a supersaturated solid solution. It is then aged at a lower temperature of around 900-1000° F. for a few hours to precipitate a fine dispersion of gamma prime particles throughout the material. The aging process improves the strength of the alloy by creating a fine distribution of particles that resist dislocation movement within the material.

Titanium alloys: Titanium is a lightweight and strong metal that is often used in high-performance military applications, including artillery and gun barrels. Its high strength-to-weight ratio, corrosion resistance, and ability to withstand high temperatures make it an ideal material for these types of applications.

Ti-6Al-4V (Grade 5): This is the most common titanium alloy and is known for its high strength, low weight, and excellent corrosion resistance. It contains 6% aluminum and 4% vanadium. Post processing that may be performed on Ti-6Al-4V (Grade 5) which may be a material used to manufacture an interlocking gun:

Heat Treatment: Heat treatment is a process in which the material is subjected to heating and cooling cycles to modify its microstructure and enhance its mechanical properties. In the case of Ti-6Al-4V, the material is subjected to a solution treatment, followed by quenching, and then aging. The solution treatment is performed at a temperature of about 930° C., which allows the alloying elements to dissolve in the alpha-phase matrix. After quenching, the material is then aged at a lower temperature (usually around 500° C.), which precipitates the alpha and beta phases, leading to an increase in strength.

Cold Working: Cold working is a process in which the material is plastically deformed at a temperature below its recrystallization temperature. This process leads to an increase in the number of dislocations in the material, which enhances its strength. However, excessive cold working can lead to the material becoming too brittle, so it is crucial to control the amount of deformation.

Shot Peening: Shot peening is a surface treatment process in which the material is bombarded with small spherical particles at high velocities. This process leads to the formation of compressive residual stresses on the surface, which improves the fatigue strength of the material.

Electrochemical Machining: Electrochemical machining (ECM) is a process in which material is removed from the surface of the material by electrochemical dissolution. This process can be used to remove surface defects and to create surface textures that can enhance the fatigue strength of the material.

Surface Coatings: Various surface coatings can be applied to Ti-6Al-4V to improve its resistance to wear and corrosion. These coatings can be deposited using various techniques such as physical vapor deposition (PVD) or chemical vapor deposition (CVD). Some of the common coatings used on Ti-6Al-4V include titanium nitride, titanium carbide, and diamond-like carbon.

Ti-6Al-6V-2Sn (Grade 23): This alloy is similar to Ti-6Al-4V, but with the addition of 6% aluminum, 6% vanadium, and 2% tin. It is used in applications that require high strength, low weight, and good corrosion resistance. Post processing that may be performed on Ti-6Al-6V-2Sn (Grade 23) which may be a material used to manufacture an interlocking gun:

Heat treatment: Heat treatment is a common method used to increase the strength of Ti-6Al-6V-2Sn. This involves heating the alloy to a high temperature (around 1000° C.) and then cooling it rapidly. This process is called quenching, and it causes the formation of a microstructure that is rich in alpha phase. The alloy is then aged at a lower temperature for several hours, which causes the alpha phase to transform into a stronger beta phase. This process is called aging, and it increases the strength of the alloy without making it brittle.

Cold working: Cold working is another method used to increase the strength ofTi-6Al-6V-2Sn. This involves deforming the alloy at room temperature, such as by rolling or forging, which creates dislocations in the crystal lattice. These dislocations impede the movement of dislocations under stress, resulting in an increase in strength.

Shot peening: Shot peening is a surface treatment that can be used to increase the fatigue strength of Ti-6Al-6V-2Sn. This involves striking the surface of the alloy with small, high-velocity metal pellets. This causes the surface to deform, which induces compressive stresses in the surface layer. These compressive stresses help to resist crack propagation, which improves the fatigue strength of the alloy.

Surface modification: Surface modification techniques, such as nitriding or carburizing, can be used to improve the wear resistance of Ti-6Al-6V-2Sn. Nitriding involves exposing the surface of the alloy to nitrogen at high temperature, which forms a hard, wear-resistant layer of titanium nitride. Carburizing involves exposing the surface to carbon at high temperature, which forms a hard, wear-resistant layer of titanium carbide. These surface modifications improve the wear resistance of the alloy without significantly affecting its mechanical properties.

Ti-5Al-2.5Sn (Grade 6): This alloy contains 5% aluminum and 2.5% tin, and is known for its excellent weldability, good fatigue strength, and high-temperature performance. Post processing that may be performed on Ti-5Al-2.5Sn (Grade 6) which may be a material used to manufacture an interlocking gun:

Heat Treatment: Heat treatment is a common technique used to increase the strength of titanium alloys. The heat treatment process involves heating the material to a specific temperature and holding it there for a certain amount of time, followed by a controlled cooling process. The goal of the heat treatment is to achieve a microstructure that provides optimal strength and ductility.

Cold Working: Cold working, also known as work hardening or strain hardening, is a process that involves deforming the material at room temperature to increase its strength. The cold working process can be achieved through processes such as rolling, bending, or forging, and it works by introducing defects into the material's crystal structure, which increases the number of dislocations and strengthens the material.

Age Hardening: Age hardening is a post-processing technique that involves heating the material to a specific temperature for a certain amount of time to induce precipitation hardening. In the case of Ti-5Al-2.5Sn, this involves heating the material to a temperature between 450° C. and 510° C. for a few hours, followed by a controlled cooling process. This technique increases the number of precipitates in the material's crystal structure, which strengthens the material without making it brittle.

Shot Peening: Shot peening is a surface treatment that involves blasting the material's surface with small metal balls to create a compressive residual stress layer. This process works by introducing compressive stresses into the material's surface, which helps to prevent crack initiation and propagation, increasing the material's fatigue life.

Electrolytic Etching: Electrolytic etching is a process that involves etching the material's surface using an electrolyte solution to remove surface contaminants and increase the surface area. This process works by introducing surface defects, which can strengthen the material by increasing the number of nucleation sites for dislocations.

Ti-3Al-2.5V (Grade 9): This alloy contains 3% aluminum and 2.5% vanadium, and is known for its high strength, good weldability, and excellent corrosion resistance. Post processing that may be performed on Ti-3Al-2.5V (Grade 9) which may be a material used to manufacture an interlocking gun:

Heat treatment: Heat treatment is a common post-processing technique used to improve the mechanical properties of titanium alloys. The heat treatment process involves heating the alloy to a specific temperature and holding it for a certain period of time, followed by cooling it in a controlled manner. For Ti-3Al-2.5V, a typical heat treatment involves heating the alloy to a temperature between 900° C. and 950° C. and holding it for several hours before cooling it in air or water. This process can increase the tensile strength and yield strength of the alloy while maintaining its ductility.

Cold working: Cold working involves deforming the material at room temperature, either through rolling or drawing, in order to improve its strength and hardness. This process increases the dislocation density within the material, which impedes the movement of dislocations and makes it more difficult for them to slide past each other, resulting in a higher yield strength. Cold working can also improve the fatigue life and resistance to stress corrosion cracking of the material.

Shot peening: Shot peening is a process that involves striking the surface of the material with small, spherical particles in order to induce compressive residual stresses in the surface layer. This compressive stress layer can improve the fatigue life of the material by reducing the initiation and propagation of cracks.

Surface treatments: Surface treatments such as anodizing, nitriding, and chromizing can be used to improve the surface properties of titanium alloys. These treatments can improve the wear resistance, hardness, and corrosion resistance of the material while maintaining its ductility.

Alloying: Alloying with small amounts of other elements such as aluminum, vanadium, or molybdenum can improve the strength and hardness of titanium alloys. This process can also improve the corrosion resistance and high-temperature performance of the material.

Ti-15V-3Cr-3Sn-3Al (Beta C): This alloy contains 15% vanadium, 3% chromium, 3% tin, and 3% aluminum, and is known for its high strength, toughness, and corrosion resistance. Post processing that may be performed on Ti-15V-3Cr-3Sn-3Al (Beta C) which may be a material used to manufacture an interlocking gun:

Heat Treatment: One of the most common methods of post-processing titanium alloys is heat treatment. Heat treatment involves exposing the material to high temperatures for a specific amount of time, followed by rapid cooling. In the case of Ti-15V-3Cr-3Sn-3Al, heat treatment is used to achieve a range of mechanical properties, including high strength and fatigue resistance. The specific heat treatment used depends on the desired properties, but typically involves a combination of solution treatment and aging.

Cold Working: Another method of post-processing titanium alloys is cold working, which involves deforming the material at low temperatures to induce plastic deformation. This process can increase the strength and hardness of the material by introducing dislocations and other defects in the crystal structure of the metal. Cold working can be carried out using a variety of methods, including rolling, forging, and drawing.

Surface Treatments: Surface treatments are used to modify the surface properties of titanium alloys without changing the bulk material properties. Surface treatments can improve the resistance to wear, corrosion, and fatigue, and can be applied through a range of techniques, such as electroplating, anodizing, and shot peening.

Alloying: Alloying is another way to increase the strength of titanium alloys. Ti-15V-3Cr-3Sn-3Al can be alloyed with other metals, such as molybdenum and silicon, to improve specific properties, such as high-temperature strength and ductility.

Grain Refinement: Grain refinement involves reducing the size of the grains in the microstructure of the material. This is achieved by adding certain alloying elements, such as aluminum and vanadium, or through the use of specific heat treatment processes. Grain refinement can improve the strength, ductility, and toughness of titanium alloys.

Ti-6Al-2Sn-4Zr-2Mo (Beta 21S): This alloy contains 6% aluminum, 2% tin, 4% zirconium, and 2% molybdenum, and is known for its high strength, good corrosion resistance, and excellent weldability. Post processing that may be performed on Ti-6Al-2Sn-4Zr-2Mo (Beta 21S) which may be a material used to manufacture an interlocking gun:

Heat Treatment: Heat treatment is the most commonly used post-processing technique for Beta 21S. The alloy is typically annealed at a temperature of around 1600° F. for several hours, followed by air cooling or water quenching. This process helps to refine the microstructure of the alloy and improve its mechanical properties.

Hot Working: Beta 21S can be hot worked to enhance its tensile strength and ductility. Hot working is performed at temperatures above the beta transus temperature (around 1700° F.) to facilitate plastic deformation. Hot working can be performed using techniques such as forging, rolling, or extrusion.

Cold Working: Cold working is another post-processing technique used to enhance the tensile strength and ductility of Beta 21S. Cold working is performed at temperatures below the beta transus temperature and includes techniques such as cold rolling or cold drawing. Cold working increases the strength of the alloy by inducing dislocations and defects in the crystal structure.

Stress Relieving: Stress relieving is a post-processing technique used to reduce residual stress in Beta 21S. This process is performed at a temperature below the beta transus temperature and involves holding the alloy at a specific temperature for a specified period of time. Stress relieving helps to prevent stress corrosion cracking and improve the fatigue resistance of the alloy.

C. Detailed Discussion of an Example Embodiment

C.1 Figures

FIG. 1—IPG System Assembly

FIG. 1 is an isometric view of one version of an IPG System. This shows the complete assembly, without the controls housing or other downhole tools connected to the system. The IPG Assembly may be a wet system. Meaning it may be pressurized to equalize to the environment that it is in.

100—Interlocking Gun Body One ('Body One')

Body One is a symmetrical gun body that may be, but not limited to, machined, casted, or 3D printed out of a, but not limited to, alloy material such as, for example but not limited to, 4330 Vanadium modified. As shown in various other Figures herein, Body One may comprise receivers, barrels, propellant chambers, and electronics trays.

Body One may comprise receivers and barrels that are identical mates to an additional Interlocking Gun Body, such as Interlocking Gun Body Two, as discussed below. Thus, example mating gun bodies may have the same shape and size, allowing the Body One to interlock with an additional Interlocking Gun. Being identical may allow Body One to be installed in either orientation, which may make it more versatile and easier to assemble.

The interlocking mechanism of gun Body One may comprise two or more mating surfaces that interlock with corresponding surface(s) on the barrel and receiver. These surfaces of Body One and/or the corresponding surfaces of the barrel and receiver may be angled, or shaped in a specific way to provide the system with a secure and tight fit between Body One and Body Two, and may, in one embodiment, be fastened together in place. By providing a symmetrical and interlocking design to gun Body One, a tight and stable connection between the two bodies may be made that may enable efficient performance of the system when firing.

101—Interlocking Gun Body Two ('Body Two')

Body Two may comprise a symmetrical gun body that may be made in various ways, such as machined, cast, or 3D printed out of an alloy material such as, for example, 4330 Vanadium Modified. Body Two may comprise, receivers, barrels, propellant chambers, and electronics trays.

Body Two may comprise receivers and barrels that are identical mates to an additional Interlocking Gun Body, such as Interlocking Gun Body One. Thus, example mating gun bodies may have the same shape and size, allowing the Body Two to interlock with an additional IPG system gun. Being identical may enable Body Two to be installed in either orientation, which may make it more versatile and easier to assemble.

The interlocking mechanism of gun Body Two may comprise two or more mating surfaces that interlock with corresponding surface on the barrel and receiver. These surfaces may be angled, or shaped in a specific way to provide the system with a secure and tight fit between Body Two and Body One, and may be secured, or fastened together in place. By providing a symmetrical and interlocking design to gun Body One, a tight and stable connection between the two bodies may be made that may enable efficient performance of the system when firing. The configuration of Body One and Body Two and the connection between Body One and Body Two may, when the IPG gun is assembled and ready for use, serve to restrict, or prevent, relative motion between Body One and Body Two along a longitudinal axis and a radial axis, among others, of the IPG gun.

Further, in an embodiment, the guns are identical, so they can match with any gun and match in one direction and another direction—that is, a gun may be flipped around and it will match up with another interlocking gun.

102—Receiver

In an embodiment, the receiver may comprise a cylindrical tube that interlocks, or mates with a barrel 106*b*. The receiver may have an inside diameter of 0.500"-0.600". The receiver may also have a barrel length in a range of 1.000"-7.000". These parameters of receiver diameters and lengths are provided by way of example and may depend on considerations such as the environment where the IPG system is to be deployed, such the pipe or casing inside diameter in which the IPG System is operating in.

As discussed below, the barrel 106*b* may define the terminal portion of the travel path of the penetrator once the system is fired. That is, the penetrator may travel through the receiver before exiting the from the barrel 106*b*. The receiver may be configured to handle internal pressures up to, but not limited to, 150,000 PSI, without experiencing any significant damage.

The receiver may be configured to assist in controlling the direction and velocity of the penetrator as well as ensuring that adequate and sufficient forces are applied to achieve the desired effects such as perforating or penetrating a through multiple layers of pipe, or casing, wall, a layer of cement, and formation rock.

The receiver and/or the barrel 106*b*, may be configured to enable fluid and pressure from the environment that it is into free flow into the receiver before, during, and after the penetrator is fired.

Machining processes that may be used to manufacture or machine the barrel 106*b*, receivers, or portions of the receivers, may include:

Rifling: Rifling is a process of cutting spiral grooves into the inside of a barrel to impart spin to a bullet. Rifling is typically done using a broach, which is a long, narrow cutting tool with multiple cutting edges. The broach is pulled through the barrel, cutting the grooves as it goes.

Button Rifling: Button rifling is a process where a tungsten carbide button is pulled through the barrel to create the grooves. The button is shaped to the desired profile of the rifling, and as it is pulled through the barrel, it deforms the metal, cutting the grooves.

Honing: Honing is a process of polishing the inside of a barrel to improve its finish and reduce the roughness of the surface. Honing is typically done using a honing machine, which uses a series of abrasive stones to remove material from the barrel.

Reaming: Reaming is a process of enlarging a hole to a precise diameter and finish. Reaming is typically done using a reamer, which is a cutting tool with multiple cutting edges. The reamer is rotated and fed through the barrel, cutting the inside to the desired size and finish.

Buttoning: Buttoning is a process where a carbide button is used to form the inside of the barrel to the desired shape. The button is pressed into the barrel, deforming the metal, and forming the rifling or other features.

Electrochemical Machining (ECM): ECM is a non-traditional machining process where a high current is passed between the workpiece and a tool, removing material from the workpiece through electrolysis. ECM can be used to machine complex shapes and features inside a barrel, including rifling.

Broaching: Broaching is a process where a long, narrow cutting tool with multiple cutting edges is pulled through the barrel to cut the desired shape or feature. Broaching can be used to cut grooves or other shapes inside the barrel.

Grinding: Grinding is a process where an abrasive grinding wheel is used to remove material from the inside of the barrel to achieve the desired size and finish.

Burnishing: Burnishing is a process where a hardened tool is rotated inside the barrel to smooth the surface and improve its finish.

3D Printing: 3D Printing, or additive manufacturing, uses a process called powder bed fusion to create parts from metal powders. The printer selectively fuses the metal powder layer by layer using a laser or electron beam to melt and solidify the powder into the desired shape.

In an embodiment, the receiver resides inside the receiver interlock. The receiver may serve several functions: the receiver comprise a chambering mechanism for a penetrator, and may provide the capability to chamber penetrators of multiple different geometries, weights, and materials; the receiver may act as a sealing surface between the external environment and the propellant chamber; and, the ignition of the propellant in the propellant chamber may take place at the bottom of, or inside of, the receiver.

103—Fastener

The fastener that may be used to fasten the IPG System together may comprise any thread and corresponding nuts that may be torqued to a specific specification. Other fasteners that may be used include: bolts; screws; nuts; washers; studs; pins; rivets; cotter pins; snap rings; adhesive fasteners; clamps; wedge anchors; expansion bolts; threaded rods; t-nuts; socket head cap screws; allen head bolts; u-bolts; flange bolts; shoulder bolts.

104—Coupling

The coupling may be an outer diameter threaded split coupling that is fastened together onto the coupling interface. The coupling may be used to, but not limited to, connect other tools or assemblies to the IPG System. Due to the flexibility of an embodiment of the IPG System, it may be designed and manufactured to various outside diameters ranging from 2.00" to 9.00", for example, outside diameters once assembled. These outside diameters may be dependent on casing, or pipe, size, for example.

Figure 2:
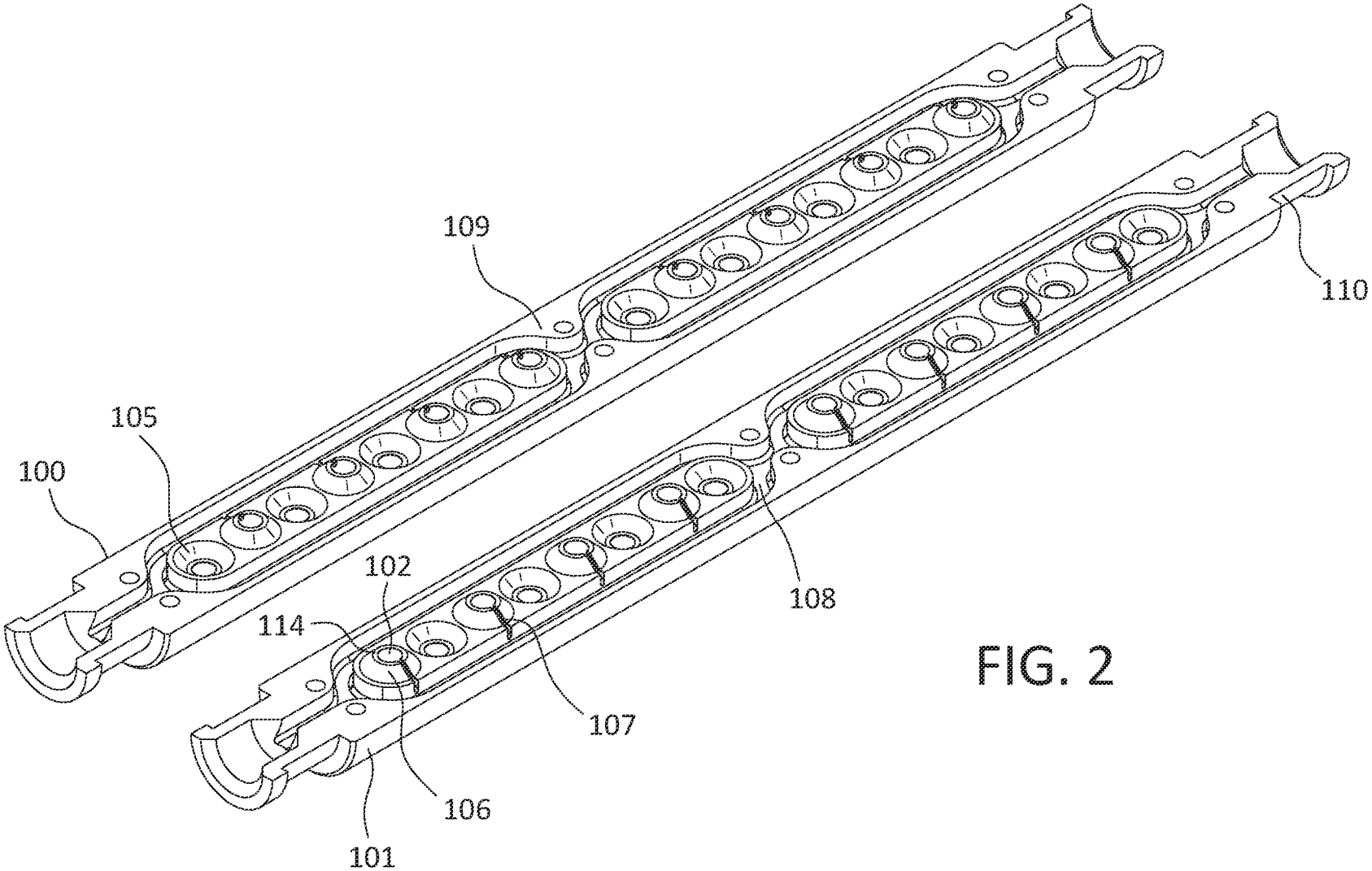
FIG. 2 discloses an isometric view of a disassembled non-charged IPG system according to one embodiment.

FIG. 2—Isometric View of Disassembled Non-Charged IPG System

FIG. 2 is an isometric view of interlocking Gun Body One and interlocking Gun Body Two. The assembly in FIG. 2 is not charged, or loaded, with propellant, penetrators, or wiring.

105—Receiver Interlock

The receiver interlock may be configured with a smooth surface that interlocks with the barrel interlock 106, an example of which is discussed below. The surface of the receiver interlock may comprise a concave shape that may be angled, such as at about 45 degrees for example, to allow for a perfect fit, or interlocking mate, with a barrel interlock having a configuration that is complementary to that of the receiver interlock.

The receiver interlock may be configured with an angle of about 45 degrees, for example, that may be more or less than about 0.300" in depth. The receiver interlock may also have a receiver interlock interface, such as in the form of a surface for example, that may mate with, such as by contacting, a barrel interlock interface, an example of which is discussed below. This surface may comprise a flat surface at the bottom of the concave.

106—Barrel Interlock

The barrel interlock may comprise a smooth surface that is configured to mate and interlock with a receiver interlock. The surface of the barrel interlock may be a convex shape that may be angled for a perfect fit, or interlocking mate, with a receiver interlock.

The barrel interlock may be designed with an angle of, but not limited to, 45 degrees that may be, but not limited to more or less that 0.300" in length. The barrel interlock may comprise a barrel interlock interface configured to interface with a corresponding surface defined in the receiver interlock. This surface may comprise a flat surface at the top of the convex.

The barrel interlock interface may be configured to include a center core, or chamber, where the penetrator may be chambered. When the propellant is ignited, the penetrator is propelled out of its chambered position located in the chamber of the barrel interlock interface.

When the penetrator is fired, the interlock between the barrel interlock interface and the receiver interlock interface may ensure that the barrel remains securely attached to the receiver at high pressures and forces that are generated when the system is fired. The interlock between the barrel interlock interface and the receiver interlock interface may also allow for some gas expansion through the system as the penetrator travels through the receiver. The gas expansion at this point may relieve some of the pressure generated by the ignition of the propellant.

The barrel interlock interface may comprise a gas port that also acts as a wire way for the command wire to reside. The command wire travels from the gas port of the barrel interface to the electric primer.

**106*b***—Barrel

In an embodiment, a terminal portion of the barrel may include one or more ports positioned at an angle relative to a longitudinal axis to the barrel. The ports may enable gases and other combustion products, resulting from ignition of a propellant, to escape and thereby prevent, or reduce, buildup of gas pressure in the barrel. The ports may be arranged so that they are blocked by a penetrator or sabot prior to ignition of the propellant. In an embodiment, the ports may implement a functionality similar, or identical, to the functionality of a muzzle brake positioned near the end of a rifle barrel.

114—Barrel Interlock Interface

The barrel interlock interface may serve several functions including:

- A sealing surface between the barrel interlock and the receiver interlock
- A mechanism for landing, or securing, the penetrator in place
- A mechanism that may house a valve that may minimize gas expansion through the gas port and between the barrel interlock and receiver interlock
- A mechanism that may incorporate a restrictor, or burst disk, that must be sheared, or broken, before initial movement of the penetrator.
- A certain pressure must be achieved below the penetrator inside of the barrel before the burst disk can be sheared or broken.

Example—when the propellant inside the propellant chamber is ignited, pressure will increase quickly inside the propellant chamber. That pressure must exceed the force required to shear the burst disk in order to move the penetrator from its chambered position and expel it out of the barrel and receiver.

107—Gas Port

The gas port may act as an outlet, or inlet, for the electrical wiring that may be connected to the electric primer. The gas port may be epoxy filled, or filled with a filler substance like epoxy once the electrical wiring is installed in the valley of the gas port.

The gas port may also serve to regulate the pressure of the gases produced by the combustion of the gunpowder during firing.

The gas port may be located near the muzzle end of the barrel, and it may be drilled at an angle, relative to a longitudinal axis of the barrel, to direct the gas in a specific direction that does not negatively affect the performance of the IPG System.

The gas port works by allowing a small amount of high-pressure gas to escape from the barrel, reducing the pressure buildup in the barrel and preventing the penetrator from being pushed too hard by the expanding gases. This helps to reduce recoil and improve efficiency by reducing the effect of muzzle, rise, that is, the rise of the very tip or end of the barrel.

The size of the gas port may be of various sizes. If the gas port is too small, it will not allow enough gas to escape, leading to increased pressure and recoil. If the gas port is too large, it will allow too much gas to escape, reducing the pressure behind the bullet and decreasing the velocity and accuracy of the shot.

The position of the gas port may also be important, as it needs to be located in a position that allows the gas to escape efficiently while still directing it in a direction that does not negatively affect the performance or efficiency of the IPG System. The angle of the port may be between 30 and 45 degrees from the axis of the barrel.

108—Electronics Tray

The electronics tray be a flat, rectangular tray that may be, but not limited to, machined into the IPG System. The tray may be manufactured with raised edges around the perimeter to contain the wires or other electrical components that may need to be concealed or harnessed. Wires and cables may be laid inside the electronics tray and secured in place with, but not limited to, cable ties, zip ties, electrical tape, or other cable management devices.

109—Fastener Interface

The fastener interface may comprise, for example, a cylindrical hole or passage that may have a uniform diameter along its length that may be a smooth bore without any grooves or ridges that may enable a threaded fastener to be inserted into.

The fastener interface may mate up with the fastener interface that is on another gun body. When the two gun bodies are interlocked together, the fastener interfaces may perfectly, or at least closely, align with one another and enable a threaded fastener to be inserted into and be torqued together with nuts.

110—Coupling Interface

The coupling interface may comprise an interface that is smooth on its outer diameter so as to be able to interface with a split coupling (not shown in FIG. 2).

Figure 3:
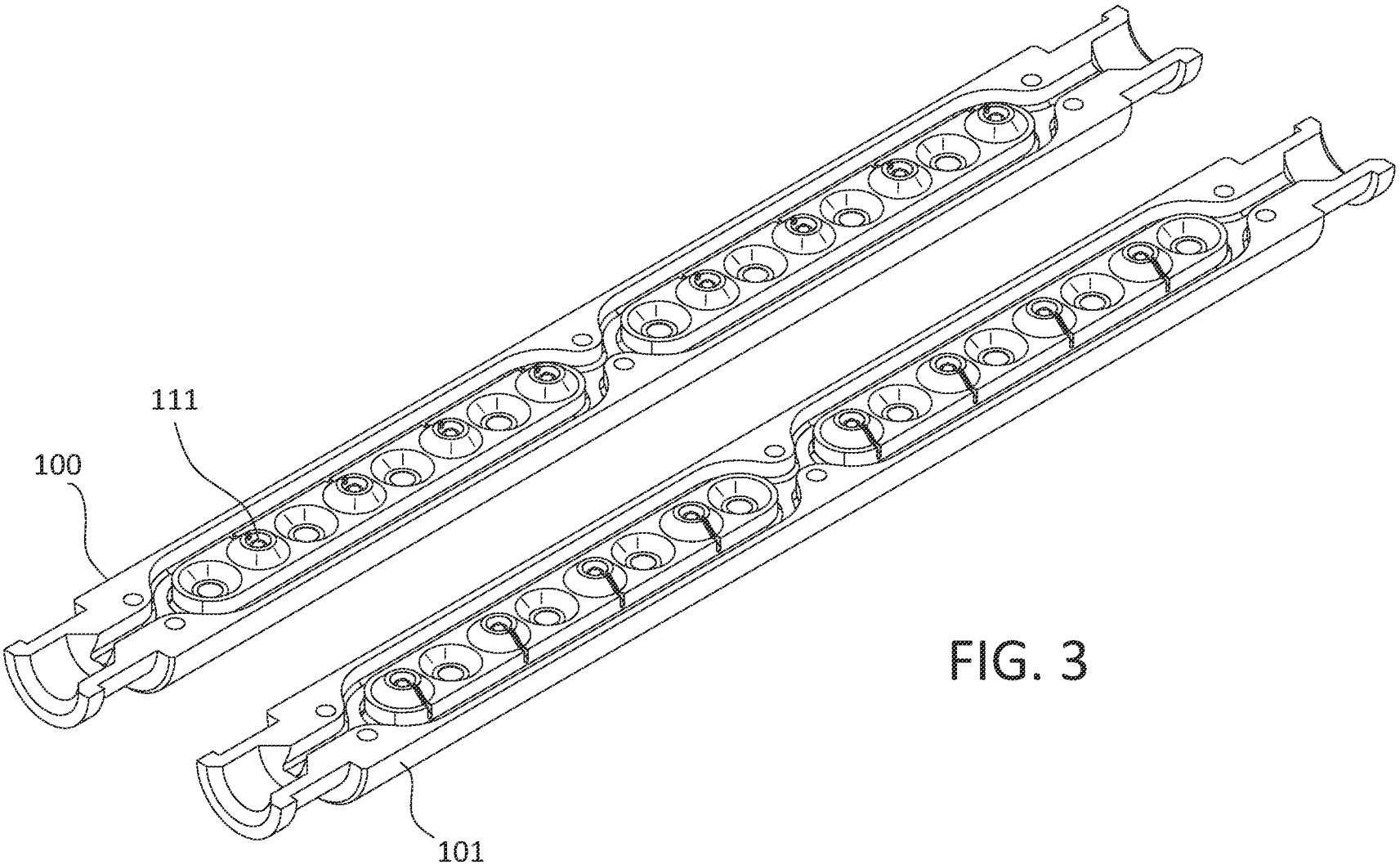
FIG. 3 discloses an isometric view of a disassembled charged IPG system according to one embodiment.

FIG. 3—Isometric View of Disassembled Charged IPG System

FIG. 3 is an isometric view of Interlocking Gun Body One and Interlocking Gun Body Two. The assembly in FIG. 3 is charged, or loaded, with propellant and penetrators. FIG. 3 is a continuation of FIG. 2 and has the same components with addition to the Penetrator.

111—Penetrator

The penetrator may comprise an alloy material that may be configured with different shapes and sizes that may be fired from the IPG system. The penetrator may be chambered in the chamber of the barrel interface. Below the penetrator may be the propellant chamber.

The penetrator may, in one embodiment, also be equipped with a sabot that may act as a sealing agent for the penetrator. The sabot may also add to the overall grain weight of the penetrator, creating more mass and effectively enabling more energy transfer into the penetrator on impact.

Figure 4:
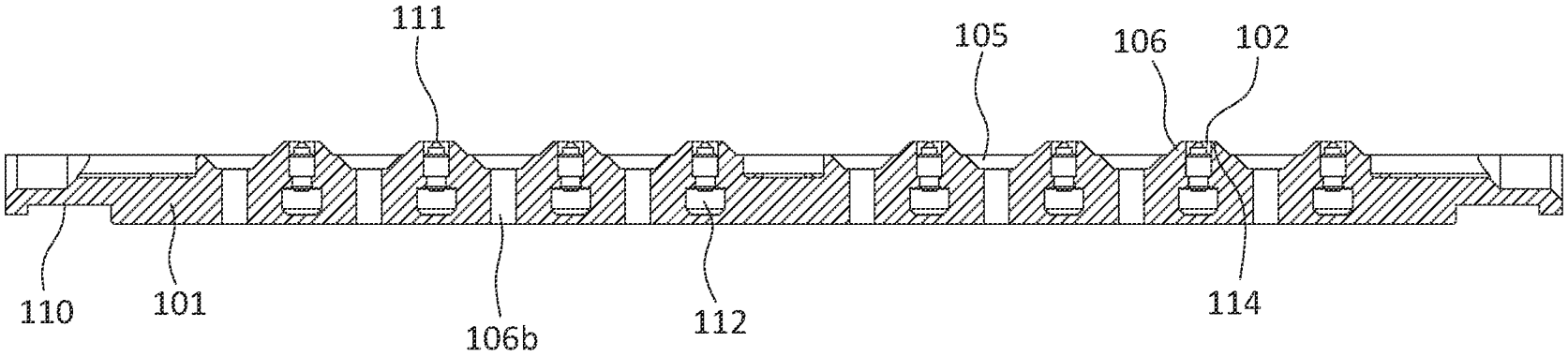
FIG. 4 discloses a cross section side view of charged IPG system body according to one embodiment.

FIG. 4—Cross Section Side View of Charged IPG Body

FIG. 4 is a cross-section side view of an interlocking gun body that is charged, or loaded, with penetrators and propellant. The interlocking interface of the interlocking gun body is the top side of the assembly shown in FIG. 4. That top side section is the section that may interlock with another interlocking gun body.

112—Propellant Chamber

The propellant chamber may be configured to be completely filled with a propellant, such as one or more smokeless powders.

The propellant chamber may be designed to house between 30 grains of smokeless powder and 100 grains of smokeless powder.

The propellant chamber may be configured to have various shapes including, for example, a cylindrical disc as an internal shape with a breech located at the bottom of the propellant chamber. The breech may comprise a concave shape.

Machining processes and equipment that may be used to manufacture or machine the propellant chambers include:

End Mills with Corner Radius: End mills with corner radius have a rounded corner that allows them to machine around corners and edges without leaving sharp edges or corners.

Tapered End Mills: Tapered end mills have a conical shape that allows them to reach into small spaces and corners. They are ideal for machining tapered walls or cavities.

Ball End Mills: Ball end mills have a rounded end that allows them to machine in a circular motion, which can be useful for machining around corners and edges.

Thread Mills: Thread mills are used for cutting internal threads in small diameter holes or bores. They can be used to machine around the edges of the hole or bore.

Carbide Burs: Carbide burs are rotary cutting tools with a small, pointed shape that can be used for precise machining of small features, including edges and corners.

EDM (Electrical Discharge Machining): EDM is a non-traditional machining process that uses electrical sparks to remove material. It can be used to machine complex shapes, including corners and edges, in small diameter chambers.

Laser Cutting: Laser cutting is a non-contact method of cutting material that can be used to machine complex shapes in small diameter chambers, including corners and edges.

Ultrasonic Machining: Ultrasonic machining is a non-traditional machining process that uses high-frequency vibrations to remove material. It can be used to machine complex shapes, including corners and edges, in small diameter chambers.

Woodruff Cutter: A Woodruff cutter is a type of milling cutter that is used to machine keyways and other flat-bottomed openings inside small diameter chambers. It is mounted on an arbor and rotated at high-speed while being fed into the workpiece, creating the desired opening shape. The Woodruff cutter has a flat bottom and a circular profile with a small keyway that fits into the arbor, allowing it to cut the desired shape without damaging the surrounding material.

Live Tooling: Live tooling is a machining technique where a lathe or turning center is equipped with tools that can rotate and perform secondary operations such as drilling, tapping, or milling. In the context of machining openings inside a small diameter chamber, the live tooling would be mounted on a rotating spindle and fed into the tube to perform the desired machining operation, allowing for precise and efficient machining without the need for additional setup or repositioning of the workpiece.

3D Printing: 3D Printing, or additive manufacturing, uses a process called powder bed fusion to create parts from metal powders. The printer selectively fuses the metal powder layer by layer using a laser or electron beam to melt and solidify the powder into the desired shape.

Figure 5:
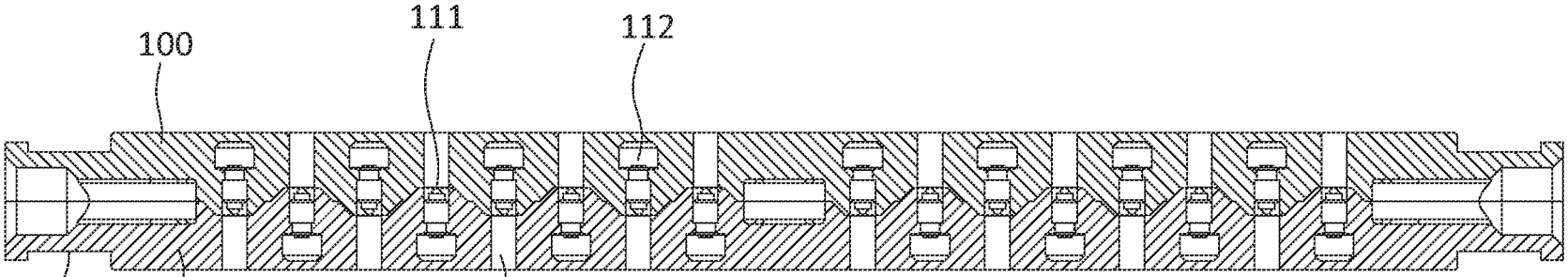
FIG. 5 discloses a cross section side view of an interlocked IPG system according to one embodiment.

FIG. 5—Interlocked IPG System Cross Section Side View

FIG. 5 is a cross section side view of an IPG System that shows how, in one embodiment, the mating bodies of the gun system interlock together with each other. The IPG System in FIG. 5 is also configured with penetrators and propellant.

Figure 6:
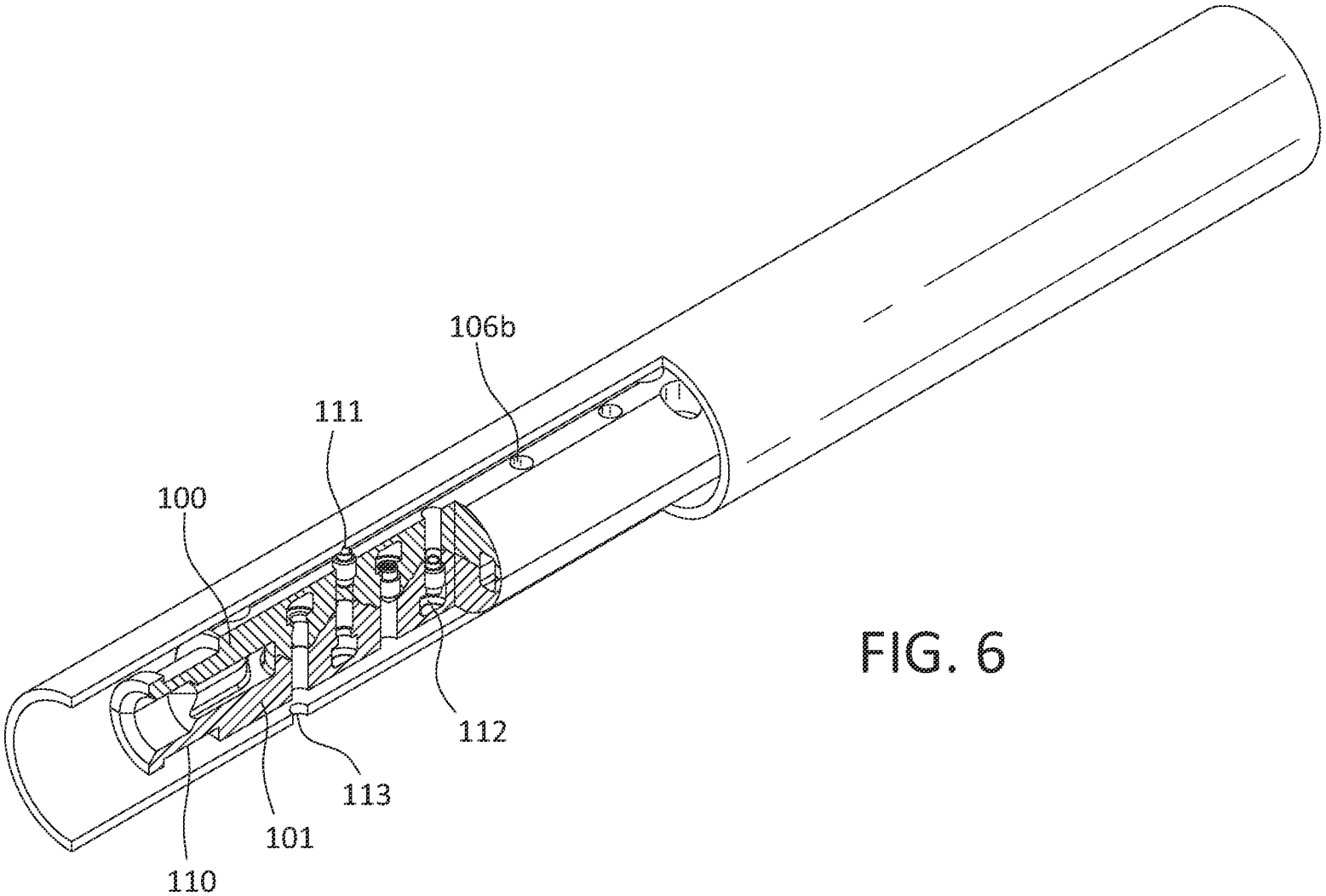
FIG. 6 discloses an isometric partial cross section of IPG system, according to one embodiment, perforating a casing or pipe.

FIG. 6—Isometric Partial Cross Section of IPG System Perforating Casing or Pipe FIG. 6 is an isometric partial cross section view of an IPG System. The IPG System shown in FIG. 6 has discharged a penetrator and created a perforation. The system is also showing a penetrator being fired and beginning to penetrate and perforate the casing, or pipe.

113—Perforation

In the example of FIG. 6, the perforation has been created in the casing, or pipe, by a penetrator that was discharged from the barrel interface of Gun Body One and through the receiver of Gun Body Two.

Figure 7:
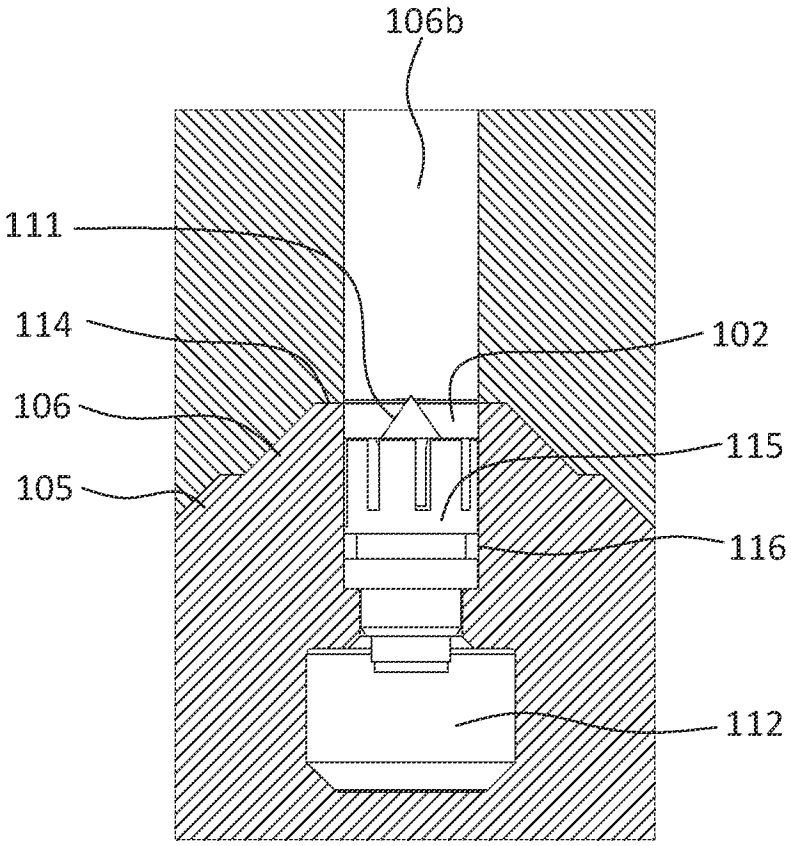
FIG. 7 discloses a cross section side view of a loaded barrel according to one embodiment.

FIG. 7—Cross Section Side View of Loaded Barrel

115—Sabot

The sabot may be made from aluminum that may perform multiple functions within the IPG System. The sabot may act as a sealing device, provide extra grain weight to the penetrator, a holder that houses a mechanical or electrical primer, as well as reduce the friction within the barrel when fired.

116—Seal Interface

The seal interface may be, but not limited to, the interface where the penetrator and or sabot seals to the chamber of the Interlocking Barrel.

The seal interface may be designed to accommodate a seal that may be an O-ring style seal, hermetic seal, epoxy sealed, or any elastomer, polymer, or mechanical or chemical sealing device that may adequately seal off the chamber.

Figure 8:
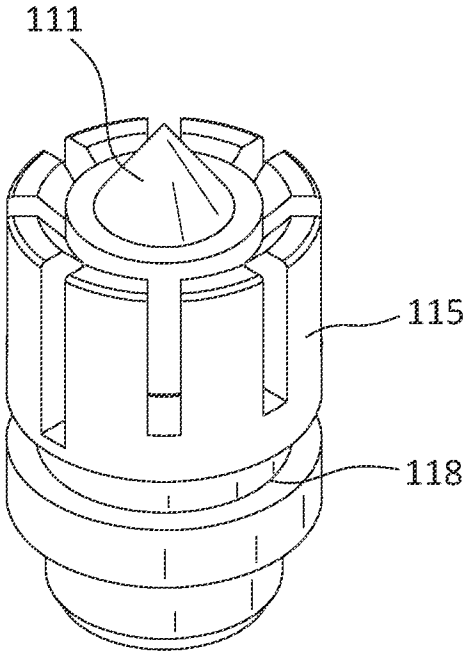
FIG. 8 discloses an isometric side view of penetrator sabot combination according to one embodiment.

FIG. 8—Isometric View Penetrator and Sabot

118—Sabot Seal Interface

The sabot seal interface may be manufactured into the sabot that may house a sealing device that may be an O-ring style seal, hermetic seal, epoxy sealed, or any elastomer, polymer, or mechanical or chemical seal that conforms to the chamber.

Figure 9:
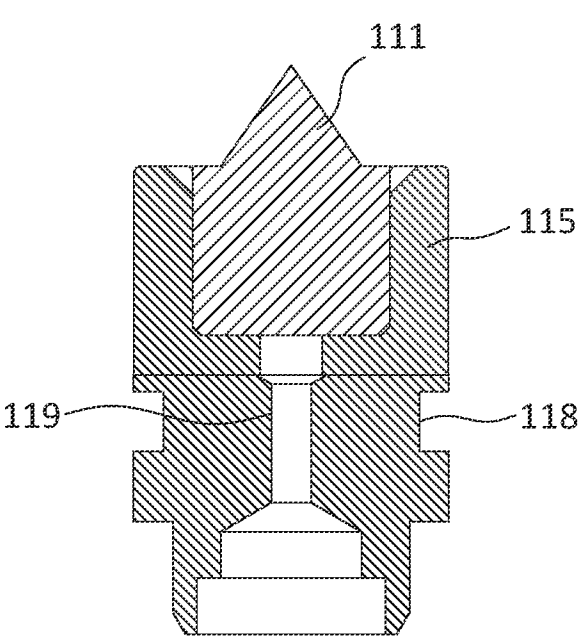
FIG. 9 discloses a cross section side view of penetrator sabot combination according to one embodiment.

FIG. 9—Cross Section Side View Penetrator and Sabot

FIG. 9 discloses a cross-section view of the example sabot seal interface disclosed in FIG. 8.

Figure 10:
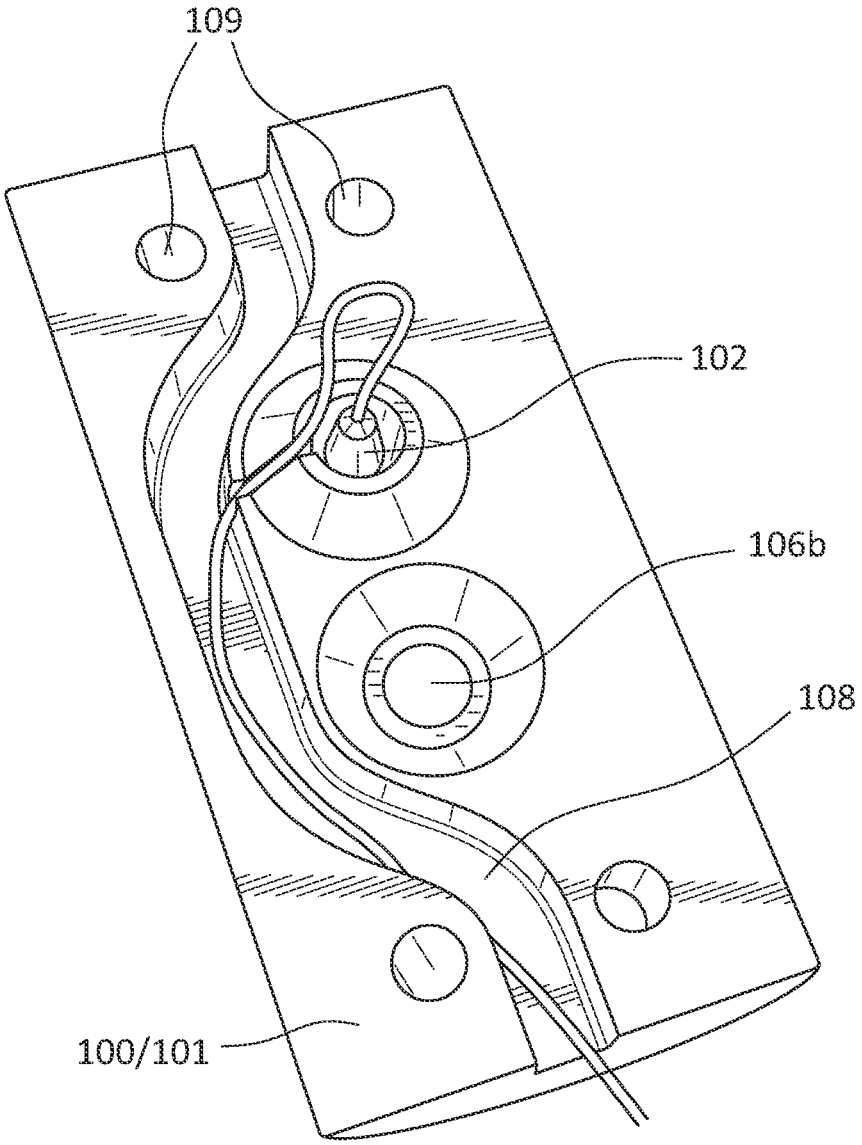
FIGS. 10, 11, and 12 disclose cutaway views of a portion of an IPG gun body according to one embodiment.
Figure 11:
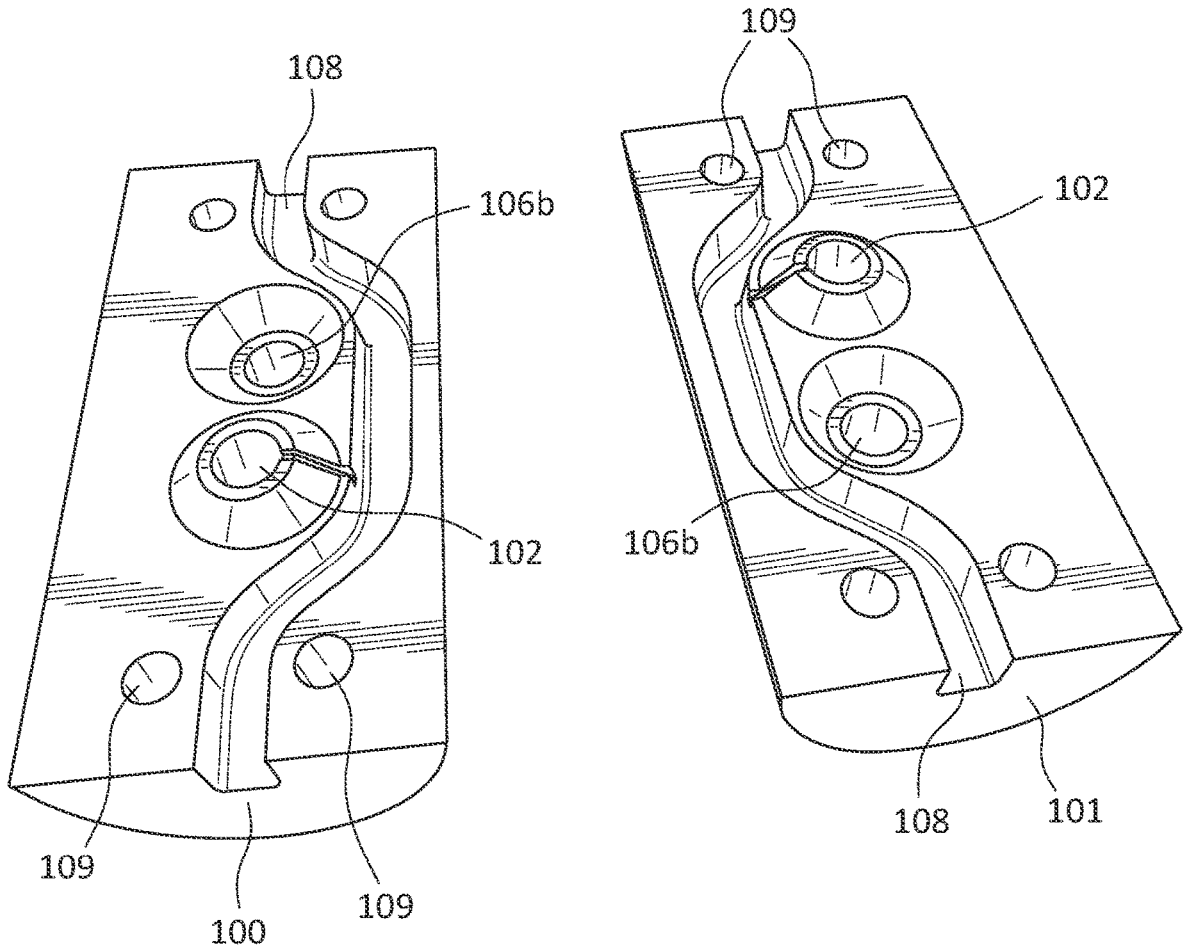
Figure 12:
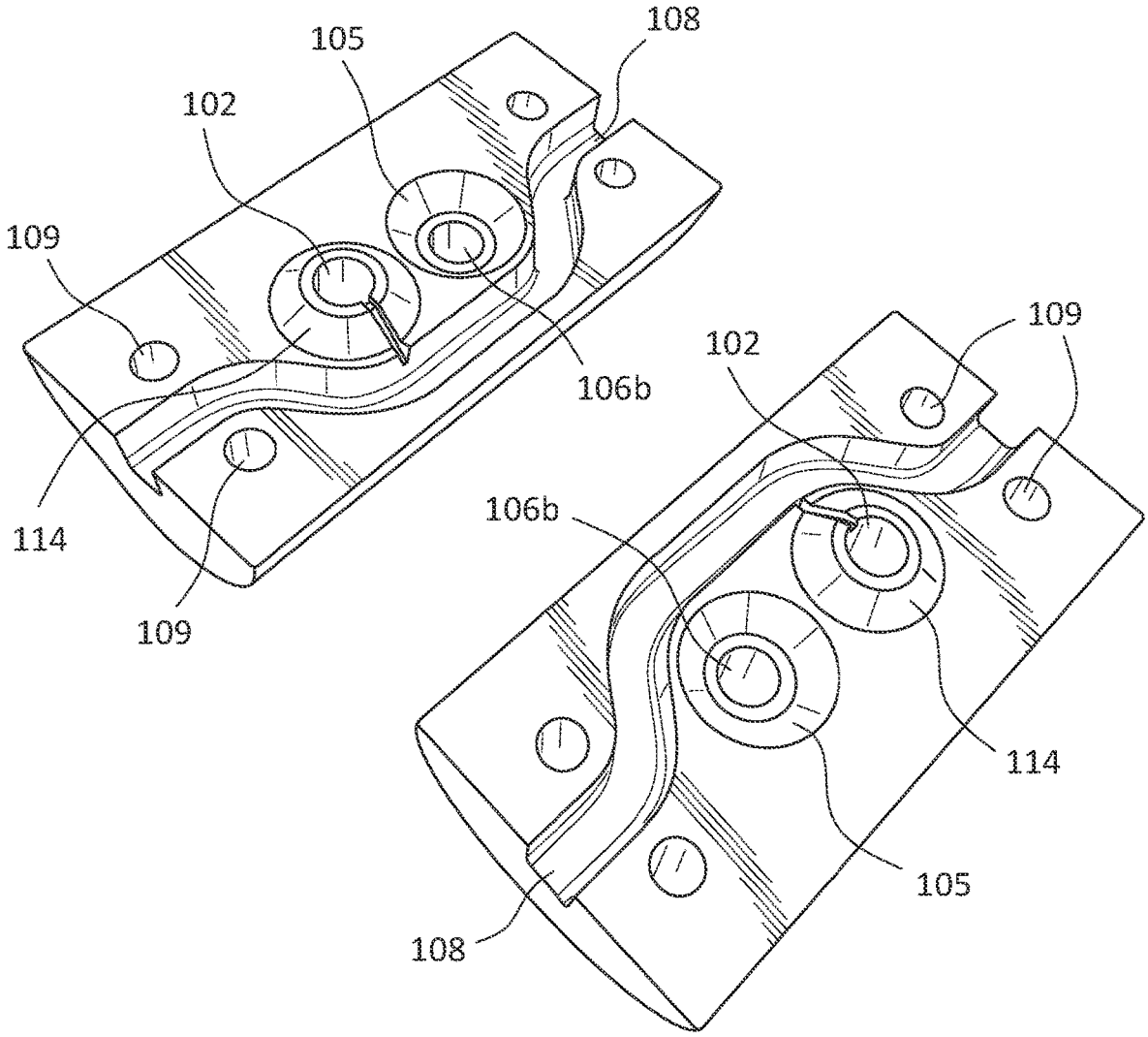
Figure 13:
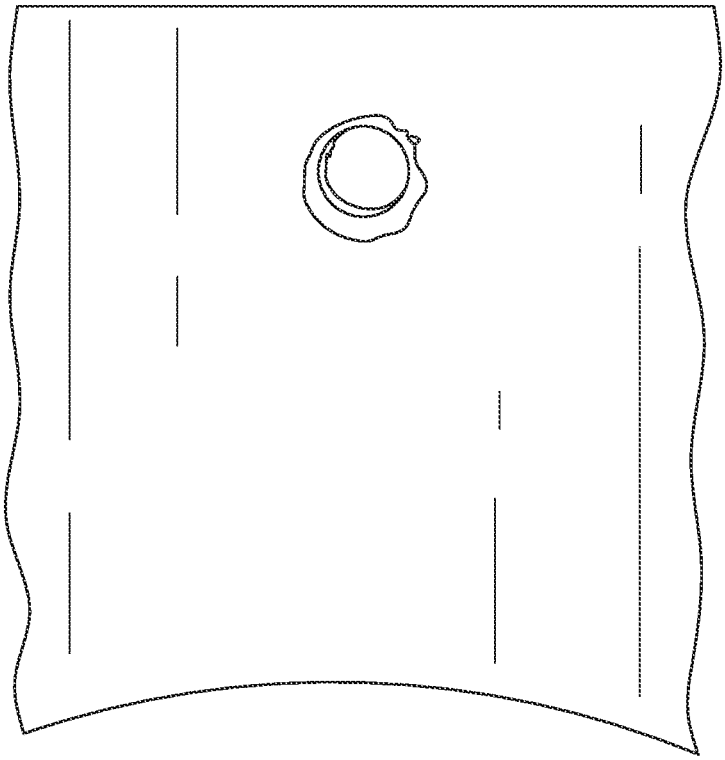
FIGS. 13, 14, 15, 16, 17, 18, and 19 disclose holes made in a well casing by an embodiment of an IPG.
Figure 14:
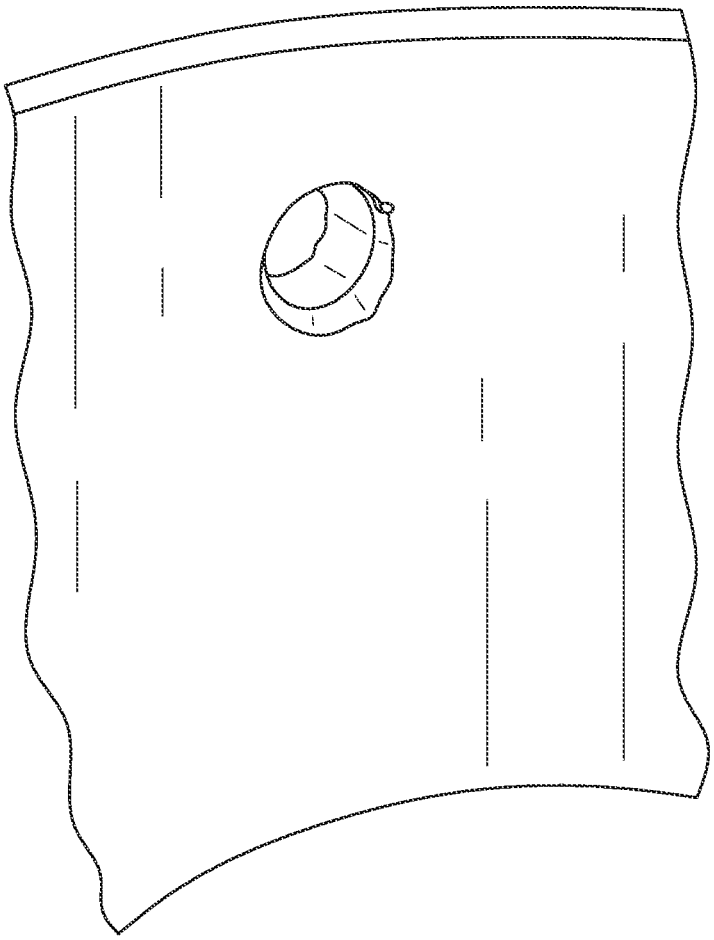
Figure 15:
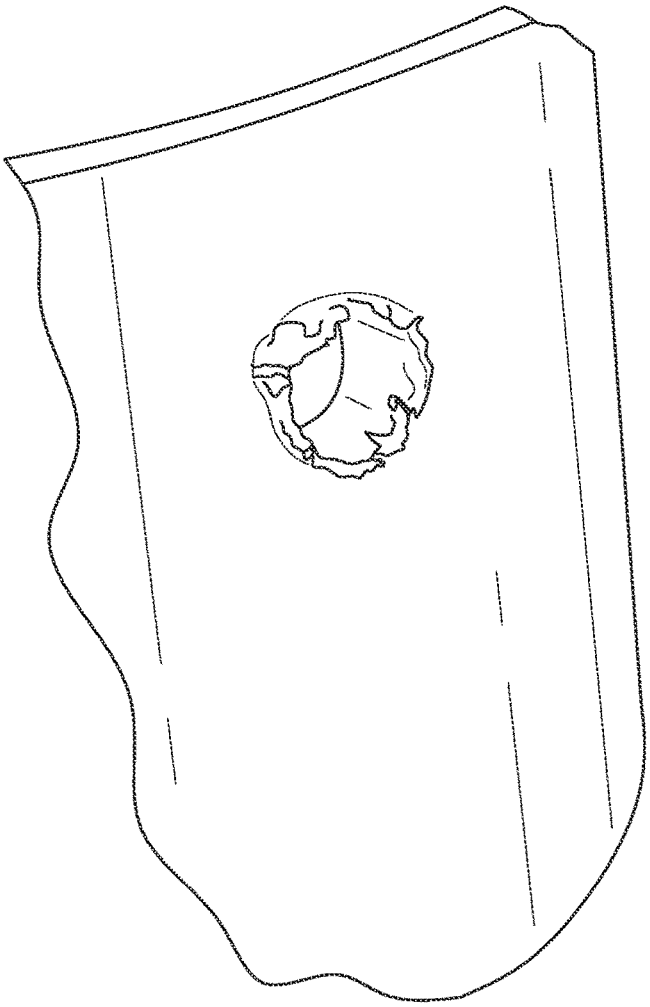
Figure 16:
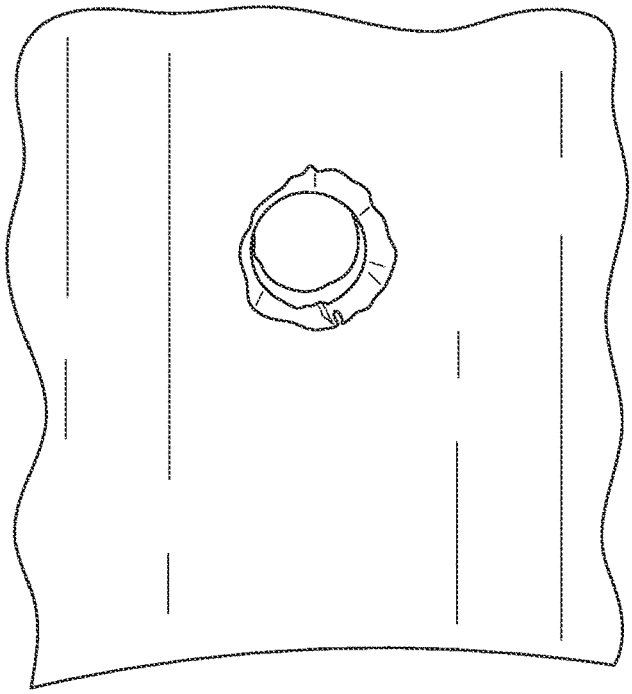
Figure 17:
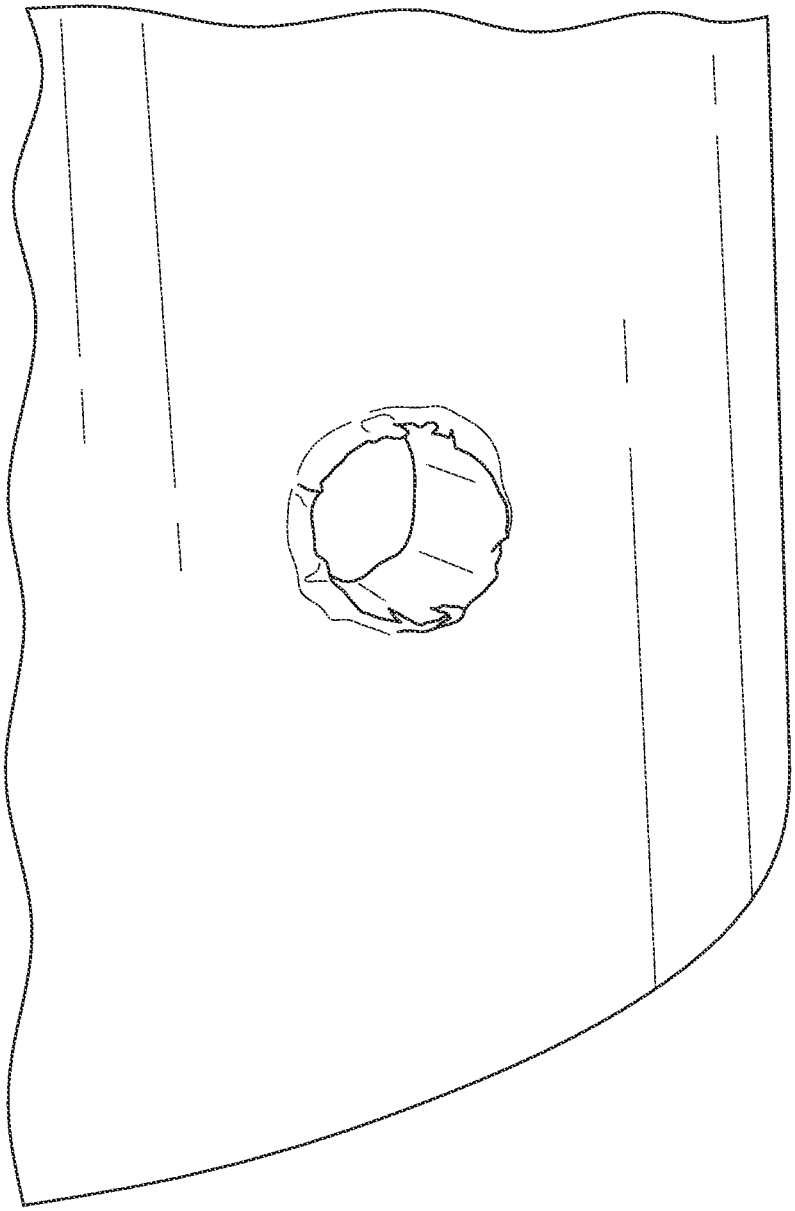
Figure 18:
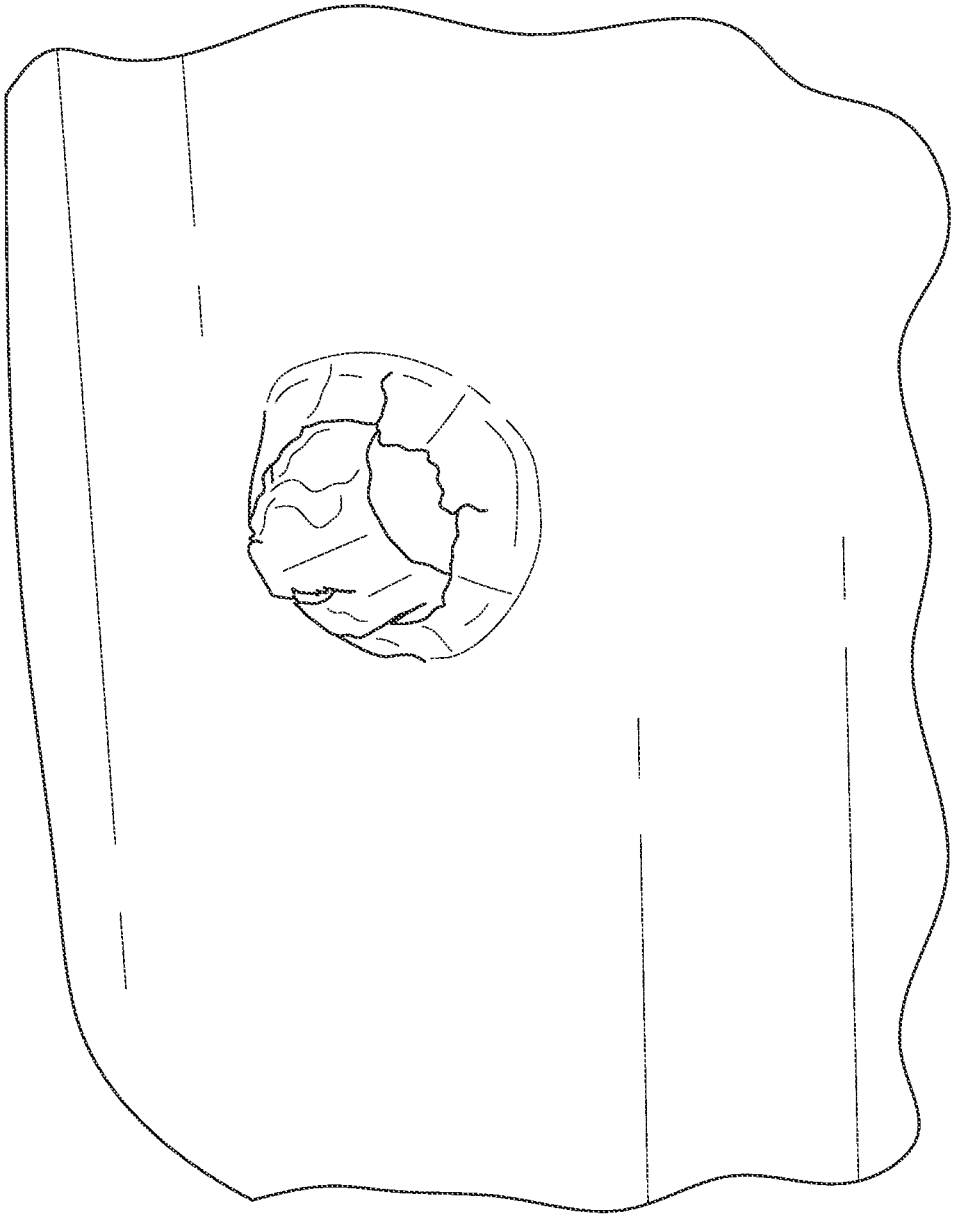
Figure 19:
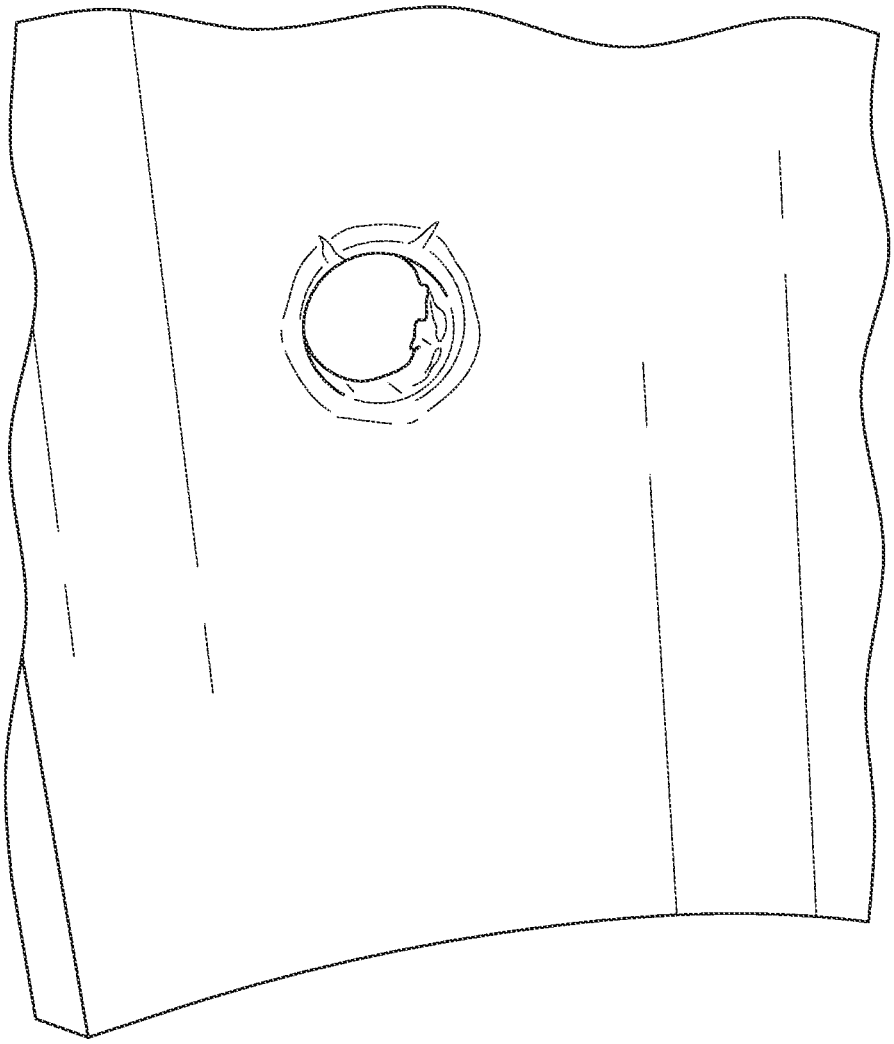

FIGS. 10, 11, and 12—Gun Bodies

FIGS. 10-12 disclose example portions of a gun body according to an embodiment.

FIGS. 13-19—Casings

FIGS. 13, 14, 15, 16, 17, 18, and 19 disclose examples of holes or perforations made by an embodiment of an IPG and one or more embodiments of a projectile.

Figure 20:
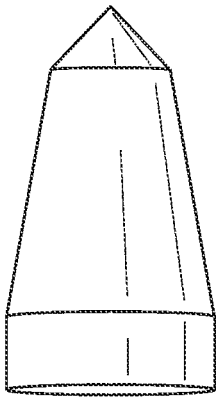
FIGS. 20 and 21 disclose example projectiles according to one or more embodiments.
Figure 21:
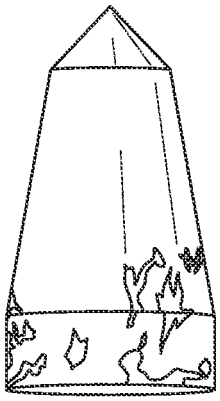

FIGS. 20-21—Projectiles

FIG. 20 discloses an example projectile, according to one embodiment, prior to firing from an embodiment of an IPG.

FIG. 21 discloses an example projectile, according to one embodiment, after firing from an embodiment of an IPG.

The described embodiments are to be considered in all respects only as illustrative and not restrictive. All changes which come within the meaning and range of equivalency of the claims are to be embraced within their scope.

What is claimed is:

1. A gun that is reloadable and reusable, the gun comprising two interlocking bodies that each comprise multiple receivers and barrels, the barrels each defining a passage that extends through the interlocking body where the barrel is located, and the passage is open at both ends, wherein the interlocking bodies are configured to interlock together so that one of the receivers of one of the interlocking bodies is aligned with a corresponding one of the barrels of the other of the interlocking bodies when the interlocking bodies are connected together.

2. The gun as recited in claim 1, wherein one of the barrels has an internal diameter in a range of 0.500" to 0.600".

3. The gun as recited in claim 1, wherein a length of the gun from breech to muzzle is in a range of 1.000" to 7.000".

4. The gun as recited in claim 1, wherein the gun is configured to receive one or more penetrators in respective receivers.

5. The gun as recited in claim 1, wherein the receivers are configured to receive penetrators of different respective shapes.

6. The gun as recited in claim 1, wherein the receivers are configured to receive penetrators of different respective lengths.

7. The gun as recited in claim 1, wherein the gun is configured and operable to project, fire, or propel, penetrators.

8. The gun as recited in claim 1, wherein the gun is configured to shoot a projectile that is configured with a sabot.

9. The gun as recited in claim 1, wherein the gun comprises a wet system and is operable to self-pressurize without losing electrical power or communication before and/or after firing.

10. The gun as recited in claim 1, wherein the gun utilizes smokeless powder as a propellant for a projectile that the gun is configured to receive.

11. The gun as recited in claim 1, comprising a propellant chamber sized to hold between 30 grains and 100 grains of smokeless powder, without the use of wadding.

12. The gun as recited in claim 1, wherein the two interlocking bodies comprise barrels and receivers that remain operable at peak pressures of 50,000 psi to 150,000 PSI while preserving reusability of the gun.

13. The gun as recited in claim 1, wherein the gun is configured and operable to propel penetrators from a barrel interface through one of the receivers and create perforations that are 1.000" in penetration past a casing outer diameter and up to 10.000" past the casing outer diameter.

14. The gun as recited in claim 1, wherein the gun is configured to centerfire from top down, towards a breech, and in an opposite direction of one of the receivers.

15. The gun as recited in claim 1, wherein one of the barrels includes a port located in a terminal portion of the one barrel.

16. The gun as recited in claim 1, wherein, in operation, the gun employs a propellant of either pellet form, or consolidated form, and the propellant comprises smokeless powder and/or black powder.

* * * * *